US007497567B2

(12) United States Patent
Kumagai

(10) Patent No.: US 7,497,567 B2
(45) Date of Patent: Mar. 3, 2009

(54) RECORDING APPARATUS

(75) Inventor: Yukitaka Kumagai, Iruma (JP)

(73) Assignee: Olympus Corporation, Tokyo (JP)

( * ) Notice: Subject to any disclaimer, the term of this patent is extended or adjusted under 35 U.S.C. 154(b) by 483 days.

(21) Appl. No.: 11/266,802

(22) Filed: Nov. 4, 2005

(65) Prior Publication Data

US 2006/0098070 A1 May 11, 2006

(30) Foreign Application Priority Data

Nov. 10, 2004 (JP) ..... 2004-326675

(51) Int. Cl.
*B41J 2/01* (2006.01)

(52) U.S. Cl. ..... 347/104; 347/101

(58) Field of Classification Search ..... 347/104, 347/101, 106, 107

See application file for complete search history.

(56) References Cited

U.S. PATENT DOCUMENTS

2003/0016269 A1* 1/2003 Sekiya ..... 347/42
2004/0066444 A1* 4/2004 Anami et al. ..... 347/104
2004/0263601 A1* 12/2004 Ishii et al. ..... 347/104

FOREIGN PATENT DOCUMENTS

JP 2001-026154 A 1/2001
JP 2001-293919 A 10/2001

* cited by examiner

*Primary Examiner*—Manish S Shah
(74) *Attorney, Agent, or Firm*—Frishauf, Holtz, Goodman & Chick, P.C.

(57) ABSTRACT

A recording apparatus, carrying out an image forming by ejecting ink from a recording head onto a recording paper transported by a recording paper transport unit, is characterized by transporting the recording paper while biasing the recording paper toward the recording paper transport by way of a recording paper bias unit equipped in the upstream direction of the recording paper transport, or equipping a paper guide upstream of the recording paper bias unit in a manner not contacting the recording paper transport unit, thereby passing the recording paper directly under the recording head without the recording paper coming in contact with the recording head even if the recording paper is curled, et cetera.

16 Claims, 18 Drawing Sheets

RECORDING APPARATUS

CROSS REFERENCE TO RELATED APPLICATION

This application claims the benefit of Japanese Application No. 2004-326675, filed Nov. 10, 2004, the contents of which are incorporated by this reference.

BACKGROUND OF THE INVENTION

1. Field of the Invention

The present invention relates to a recording apparatus comprising means for preventing a recording paper from coming in contact with a recording head even if the recording paper lifts up due to the ejection of ink thereon or a paper with a propensity to curl is used.

2. Description of the Related Art

Inkjet recording apparatuses for carrying out a recording operation by ejecting ink onto the recording face of a recording paper are widely used. Such a recording apparatus generally comprises a recording head with an ink ejection aperture forming surface for ejecting ink onto the recording face of a recording paper.

For instance, a recording head ejects ink droplets controlled based on a drive control signal supplied according to image data and formed either by the pressure of an electromechanical conversion body or the thermal energy of an electro-thermal conversion body toward the recording surface of a recording paper through the ink ejection aperture forming surface.

And, in an attempt to speed up a recording speed, there are relatively high density recording heads formed in a matrix between 300 dpi and 600 dpi for example and so called multi-nozzle, wide recording heads on which ink ejection apertures are formed across the entire recording width of a recording paper, for instance the entire width of the recording paper. Incidentally, in order to place a recording head over the entire area of recording, a structure placing a plurality of recording heads with a recording range which is equivalent to "a few tenths" of the entire recording width. In such a case, the adopted system is for securing a recording range without a gap across the entire recording range by placing a plurality of recording heads in a zigzag pattern, in order to make the recording range continuous.

Meanwhile, in order to make a recording apparatus full color, four color recording heads, i.e., CMYK (cyan, magenta, yellow, and black respectively), need to be arranged serially in the transport direction of a recording paper. This results in the recording head area becoming wide in the direction of the recording paper transport. In such a recording apparatus, the distance between the recording face of a recording paper and the ink ejection forming face must be continuously maintained at a predetermined value in order to maintain a stable recording.

The recording surface of a recording paper, however, sometimes lifts-up due to a wrinkle, curl or waviness caused by an absorption and subsequent evaporation of moisture, and further to a wrinkle or waviness, the so called cockling phenomenon, caused by the absorption of ink. Due to this, the recording paper comes into contact with the recording head, bringing about problems such as contamination of the recording head, recording head nozzle clogging, degradation of print quality, et cetera.

As countermeasures to such issues, methods have been proposed for avoiding a lift-up of recording paper, such as the one for holding down a recording paper by a hold-down member in an upstream part of the recording paper transport path, the one for maintaining flatness by sucking air through small holes in a platen member having a plurality of small holes to keep the recording surface of a recording paper close to the platen, and the one for transporting a recording paper electro-statically attached to the transport belt.

And, a laid-open Japanese patent application publication No. 2001-293919 has disclosed a method for preventing a sheet from coming in contact with a recording head by the equipping of a hold-down roller on an edge part of a carriage to which is mounted a recording head in order to constrain a sheet from lifting-up.

In the meantime, a laid-open Japanese patent application publication No. 2001-26154 has disclosed a paper hold-down mechanisms corresponding to each of recording heads placed in a plurality of columns in the direction of the recording paper transport.

SUMMARY OF THE INVENTION

The present invention is to provide a recording apparatus capable of carrying out a recording operation on a recording paper transported relatively to a recording part, with a capability of holding-down a recording sheet securely preventing it from lifting-up immediately before the recording operation.

A recording apparatus according to one aspect of the present invention, having a recording head for forming an image by ejecting ink onto a recording sheet and a recording paper transport unit, being equipped opposite the recording head, for transporting a recording paper in a flat state, comprises: a recording paper bias unit equipped upstream and/or downstream vis-à-vis the recording head for biasing the recording paper toward a recording paper transport unit; and a paper guide equipped upstream of the recording paper bias unit in a manner not contacting the recording paper transport unit.

A recording apparatus according to another aspect of the present invention, having a recording head for forming an image by ejecting ink onto a recording sheet and a recording paper transport unit, being equipped opposite the recording head, for transporting a recording paper in a flat state, comprises: a recording paper bias unit equipped in an upstream and/or downstream vis-à-vis each of a plurality of recording heads placed in the direction of the width of the recording paper for biasing the recording paper toward a recording paper transport unit.

DESCRIPTION OF THE PREFERRED EMBODIMENTS

The following is a detailed description of the preferred embodiment of the present invention referring to the accompanying drawings.

Figure 2:
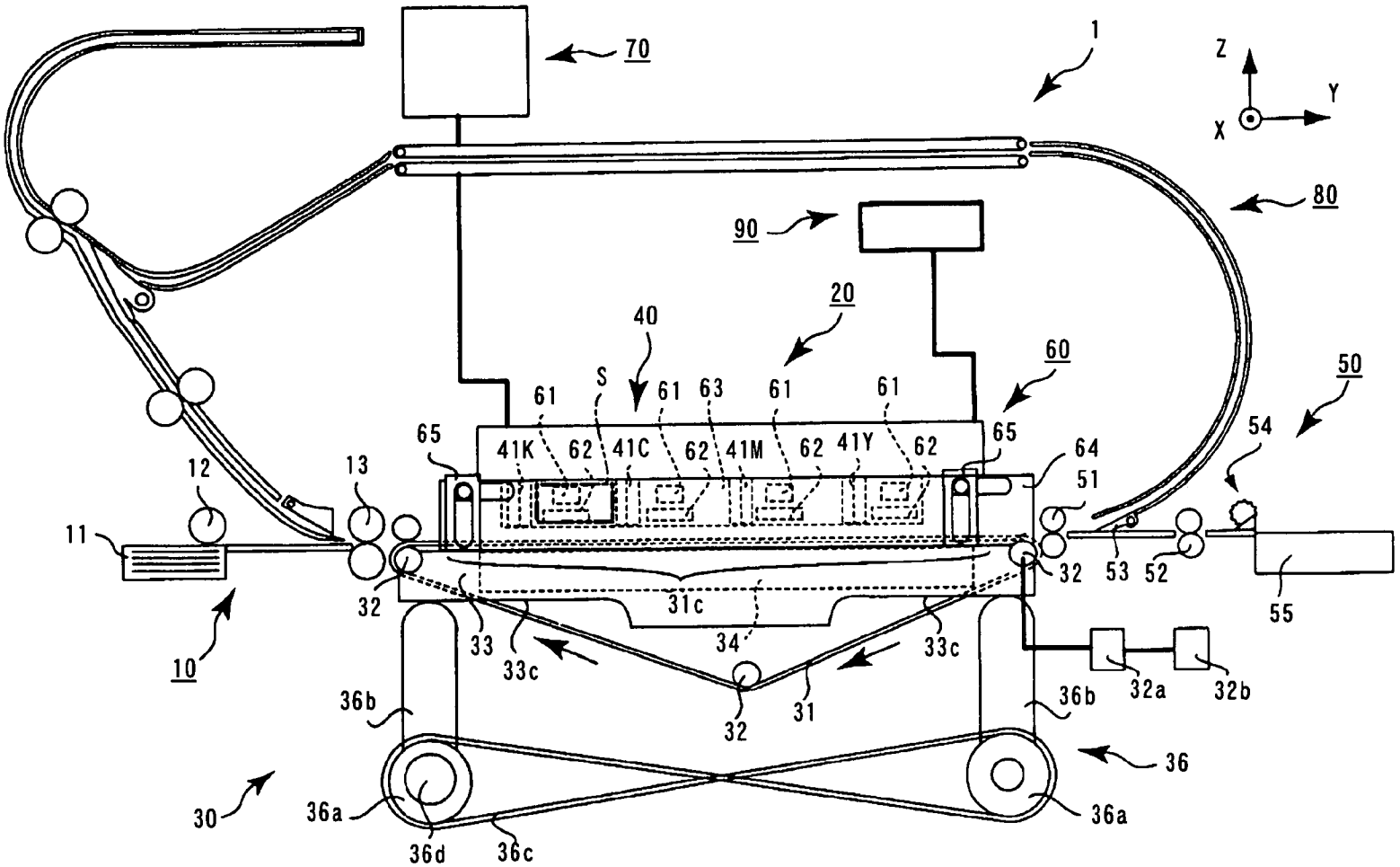
FIG. 2 is an illustrative side view of a recording apparatus according to an embodiment of the present invention.

First of all, let one embodiment according to the present invention be described while referring to FIG. 2 which is an illustrative side view of a recording apparatus according to the present embodiment.

The recording apparatus 1 according to the present embodiment comprises an apparatus frame (not shown herein), a paper feed unit 10, an image recording mechanism 20, an exit unit 50, a maintenance unit 60, an ink supply unit 70, a recording paper inversion unit 80, a control unit 90, and a paper guide unit 100 (not shown in FIG. 2).

[Paper Feed Unit 10]

The first description is of the above noted paper feed unit 10.

The paper feed unit 10 includes a recording paper tray 11, a pickup roller 12 and a registration roller pair 13. The recording paper tray 11 is a recording paper housing unit for housing at least one sheet of recording paper. The present embodiment is configured so that the recording paper housing unit houses a plurality of cut sheets of paper. Note that the recording paper housing unit can also be configured to house a roll of recording paper.

The pickup roller 12 is a recording paper pickup mechanism for taking recording paper out of the recording paper tray 11 one sheet at a time. And the pickup roller 12 is rotationally supported by the apparatus frame.

The registration roller pair 13 is a transport direction adjustment means for positioning a recording paper taken out of the recording paper tray 11, by the pickup roller 12, vis-à-vis the transport direction at the time of recording an image (i.e., a recording paper transport direction). The registration roller pair 13 is rotationally supported by the apparatus frame. Note that the axis along the recording sheet transport direction is defined as the Y-axis (i.e., the horizontal direction from the view of FIG. 2) of the present specification. And the axis perpendicular to the Y-axis on the plane (i.e., the image forming plane), where an image is formed at the time of image recording on a recording paper, is defined as the X-axis (i.e., the direction perpendicular to the surface of FIG. 2). Furthermore, the axis perpendicular to the X-axis and Y-axis is defined as the Z-axis (i.e., the vertical direction of FIG. 2). Therefore, the registration roller pair 13 makes the width direction of a recording paper practically lined up with the X-axis and at the same time makes the direction perpendicular to the width direction of a recording paper lined up with the Y-direction in the present embodiment. The registration roller pair 13 is also a recording paper transport unit for transporting the recording paper after positioning it with the image recording mechanism 20.

One roller of the registration roller pair 13 is rotationally supported by the later described image recording mechanism 20, while the other roller is rotationally supported by a lever operable by a user. Incidentally, the roller shown towards the top of FIG. 2 is a driven roller, while the other roller towards the bottom is a drive roller in the registration roller pair 13.

The lower drive roller of the registration roller pair 13 has its surface coated by glass beads of particle sizes between 15 and 120 microns by using an epoxy resin. By this surface treatment, while the total contact area with the recording paper is made small by the point contact of the glass beads, the pressing force per unit contact area is large because the total pressing force does not change. Because of this, the drive roller of the registration roller pair 13 secures a necessary transport force by the beads biting into the recording paper, while reducing the total contact area therewith adhered by ink, thereby suppressing a transfer of ink from the recording paper and preventing an image degradation such as contamination with ink on the printing face of the recording paper even in a duplex printing.

Meanwhile, such a coating process of glass beads of a transport roller gives not only benefits to the registration roller pair 13 but also the same benefits to a transport roller in the inversion mechanism used for a duplex printing, and to a transport roller and exit roller in the exit unit, et cetera. Moreover, the configuration is not limited to the glass beads but can be applied to alumina (aluminum oxide) powder or ceramic powder of similar particle sizes with the same expected benefits.

The registration roller pair 13 is placed within the size of a recording paper vis-à-vis the pickup roller 12 in the recording paper transport direction so as to transport the recording paper from the pickup roller 12 securely. This configuration makes a recording paper in transportation be in a state of the leading edge reaching the registration roller pair 13 with the trailing edge being in the nip of the pickup roller 12. Therefore, the registration roller pair 13 is assisted by the pickup roller 12 in transporting the recording paper at least until taking the leading edge thereof into the nip.

Incidentally, the path for a recording paper taken out by the pickup roller 12 being transported to the image recording mechanism 20 is defined as the paper feed transport path in the present specification. By this configuration, the paper feed transport path extends from the pickup roller 12 to the border between the paper feed unit 10 and image recording mechanism 20.

Note that the above described pickup roller 12 is connected with the registration roller pair 13 by a common drive power transmission system (not shown herein) which provides the drive power. The drive power transmission system is connected to a motor (not shown herein) whose power drives the aforementioned system. The motor is connected by an encoder for detecting the number of revolutions thereof. The motor and encoder are connected to the control unit 90 by which the drive thereof is controlled.

And the pickup roller 12 and registration roller pair 13 are configured to connect or disconnect with the drive power transmission system by way of clutches, respectively. Each of the clutches is further connected to the control unit 90 which controls the switching on or off. These rollers are configured as rotational around the X-axis according to the present embodiment.

Figure 3:
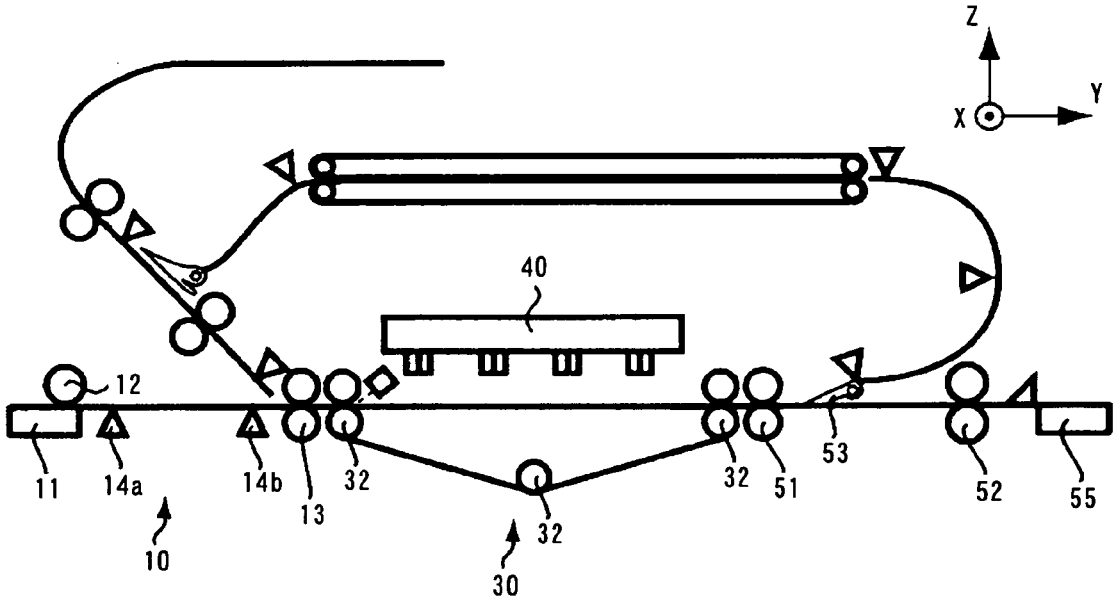
FIG. 3 is an illustration showing the placements of sensors for a recording apparatus.

Moreover, the paper feed unit 10 has a pickup sensor 14*a* and registration sensor 14*b* between the pickup roller 12 and registration roller pair 13 on the paper feed transport path as shown by FIG. 3. The pickup sensor 14*a* and registration sensor 14*b* are detection means for detecting a presence of absence of a recording paper at a predetermined position on the paper feed transport path.

The registration sensor 14*b* is placed downstream of the pickup sensor 14*a* in the recording paper transport direction. The pickup sensor 14*a* and registration sensor 14*b* are connected to the control unit 90 so as to transmit the respective detection results thereto. Incidentally, a large number of sensors are placed in the transport path of a recording paper as indicated by triangles (Δ) shown by FIG. 3, thereby detecting positions of transported paper.

[Image Recording Mechanism 20]

The next description is of the image recording mechanism 20.

Figure 4:
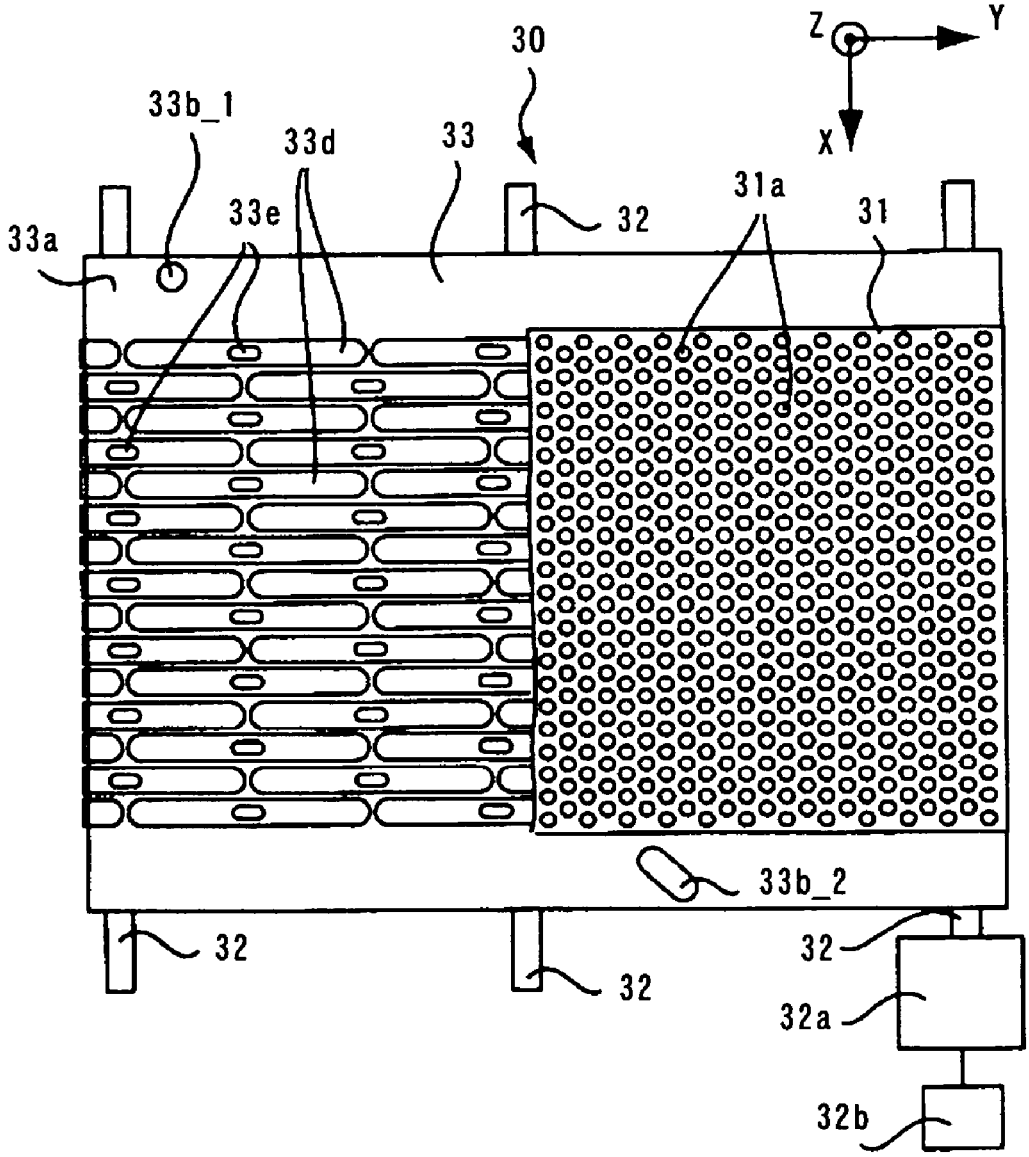
FIG. 4 is an illustrative top view of a platen unit.

The image recording mechanism 20 comprises a platen unit 30 and an image recording unit 40. First, let the platen unit 30 be described by referring to FIGS. 2 and 4. FIG. 4 is an illustrative top view of the platen unit 30.

The platen unit 30 is a transport apparatus for transporting a recording paper fed out from the paper feed unit 10 at the time of recording an image. The platen unit 30 comprises a platen belt 31, a plurality of platen belt rollers 32, a platen frame 33, a platen suction unit 34 and a platen drive unit 36.

The platen belt 31 and a plurality of platen belt rollers 32 work together to constitute a belt conveyer for carrying a recording paper along the Y-axis. In the present embodiment, the platen belt 31 is an endless belt. Note that the platen belt 31 and platen belt rollers 32 set the transport direction of a paper at the time of recording. That is, the platen belt 31 and platen belt rollers 32 are assembled so as to be able to transport a recording paper along the Y-axis across their length. Incidentally, FIG. 4 shows only the approximate half of the platen belt 31 in the direction of the Y-axis for a better description.

The plurality of platen belt rollers 32 support the platen belt 31 so as to keep it in parallel with the X- and Y-axes within the area of the platen belt 31 which faces the image recording unit 40. Meanwhile, a recording paper is transported by the platen belt 31 in the aforementioned area. Because of this, the area is called a platen recording paper transport area which is indicated by a reference sign 31*c* as shown by FIG. 2. And at least one of the platen belt rollers 32 is connected to a belt roller drive motor 32*a* for rotating the platen belt rollers 32.

And, in order to prevent a recording paper from lifting-up, driven rollers are placed in the positions facing, in terms of Z-axis, the platen belt rollers 32 which are placed on both sides in terms of Y-axis. And an encoder for generating a head control pulse is installed on the platen belt roller 32 (i.e., the platen belt roller 32 indicated on the left side of FIG. 2) on the opposite side of the platen belt roller 32 which is driven by a motor. And the belt roller drive motor 32*a* is equipped by a motor control encoder for controlling the motor drive.

The belt roller drive motor 32*a* is also connected by a roller-use encoder 32*b* for measuring the number of revolutions thereof. And the belt roller drive motor 32*a* and roller-use encoder 32*b* are connected to the control unit 90.

The width of the platen belt 31 (i.e., the size along the X-axis) is set at no less than the maximum width of a recording paper for use in an image recording. That is, if the recording apparatus according to the present embodiment accommodates a recording paper of A3 size, the width of the platen belt 31 is set at no less than the width of A3 size recording paper. And the platen belt 31 is featured by a plurality of suction holes 31*a* which are distributed evenly over the entirety thereof. Meanwhile, underneath the platen belt 31 is equipped by the platen frame 33 for supporting the aforementioned platen belt 31 in a flat state.

The platen frame 33 supports the platen belt rollers 32 rotationally and at the same time retains the platen suction unit 34. The platen frame 33 has a platen frame head facing surface 33*a* which face the image recording unit 40. The platen frame head facing surface 33*a* is parallel with the XY plane, and is formed by a plurality of grooves 33*d* elongated along the Y-axis across the entire are a facing the platen belt 31. At approximately the center of each of the grooves 33*d* is featured a surface-facing hole 33*e* which runs through to a later described platen chamber.

The platen frame head facing surface 33*a* is also featured with platen guide holes 33*b* in the area (i.e., non-platen areas) not facing the platen belt 31 for positioning with the image recording unit 40. The present embodiment is configured to comprise two of the platen guide holes 33*b*, one each upstream and downstream of the direction of a recording paper transportation. FIG. 4 shows the platen guide hole 33*b* upstream as the one indicated by the reference sign 33*b*_1, while the one downstream is indicated by the reference sign 33*b*_2.

The cross-sectional shape of the upstream platen guide hole 33*b*_1 along the X- and Y-axes is approximately a circular. The downstream platen guide hole 33*b*_2 is placed in the non-platen area on the opposite side of the platen guide hole 33*b*_1 in the direction of the X-axis. The platen guide hole 33*b*_2 is an elongate hole with the same width as the diameter of the platen guide hole 33*b*_1, and with the length being larger than the width. The longitudinal direction of the platen guide hole 33*b*_2 makes an angle of approximately 45 degrees with the X-axis.

The platen frame 33 has two of a pair of platen drive unit guides 33*c* for guiding a platen drive unit 36. These platen drive unit guides 33*c* are equipped on the opposite sides of the platen frame head facing surface 33*a* the Z-axis. And a pair of the platen drive unit guides 33*c* is equipped on both edges of the platen frame 33, respectively, in the direction of the Y-axis as shown by FIG. 2. And a pair of the platen drive unit guides 33*c* is equipped on both edges of the platen frame 33, respectively, in the direction of the X-axis. Each platen drive unit guide 33*c* has a guide surface along the X- and Y-axes, and extends from both edges of the platen frame 33 by a predetermined distance.

The platen suction unit 34 is a negative pressure generation apparatus for providing the platen frame head facing surface 33*a* with a negative pressure. The platen suction unit 34 is fixed onto the platen frame 33 on the opposite side vis-à-vis the platen frame head facing surface 33*a*. The platen suction unit 34 has a plurality of platen chambers.

These platen chambers have a platen chamber negative pressure generation source for making the pressure of each chamber itself a negative pressure. The platen chamber negative pressure generation source is a known negative pressure generation means such as a fan, and the configuration is such as to suck in air from the surface-facing holes 33*e* by the negative pressure of the platen chamber negative pressure generation source and thus suck a transported paper by way of the platen belt 31. Therefore, the surface-facing holes 33*e* are suction holes for sucking a recording paper. And each platen chamber negative pressure generation source is connected to the control unit 90 which controls the drive.

The platen drive unit 36 is a drive apparatus for driving the platen frame 33 along the Z-axis (i.e., the vertical direction of FIG. 2). The platen drive unit 36 is positioned underneath the platen frame 33 and supports it from below. The platen drive unit 36 has a pair of platen drive rotating shafts 36*a* and four of a platen support unit 36*b*.

The pair of platen drive rotating shafts 36*a* is placed on either end of the platen unit 30 in the direction of the Y-axis so as to face each other thereon as shown by FIG. 2. More specifically, one platen drive rotating shaft 36*a* (on the left side of FIG. 2) faces the other platen drive rotating shaft 36*a* (on the right side of FIG. 2) in the direction of the Y-axis, and these two are positioned below either end of the platen unit 30 in the direction of the Y-axis.

Each platen drive rotating shaft 36*a* extends along the X-axis and rotates around it. More specifically, each platen drive rotating shaft 36*a* is of a size along the X-axis such as to face the platen drive unit guides 33*c* placed on both sides of the platen frame 33 in the X-axis direction. The pair of platen drive rotating shafts 36*a* is connected so as to transmit the mutual rotating force by way of a platen drive unit belt 36*c*. And one of the pair of platen drive rotating shafts 36*a* is connected by a platen drive unit motor 36*d* whose rotation rotates the platen drive unit belt 36*c* so that the pair of platen drive rotating shafts 36*a* rotate synchronously. The platen drive unit motor 36*d* is connected to the control unit 90 by which the drive is controlled.

Meanwhile, each platen drive rotating shaft 36*a* is fixed by a platen support unit 36*b* at the position corresponding to the platen drive unit guides 33*c*, respectively, of the above described both ends in the direction of the X-axis. Therefore, two of the platen support units 36*b* are equipped for each platen drive rotating shaft 36*a*. Each platen support unit 36*b* extends itself in the radial direction of the platen support unit 36*b*. One end of each platen support unit 36*b* is fixed by the platen drive rotating shaft 36*a* as described above while the other end is contacted with the platen drive unit guide 33*c*. Therefore, the four platen support units 36*b* slide along the platen drive unit guides 33*c* according to the rotation of the platen drive rotating shafts 36*a*.

By the above described configuration, the platen frame 33 changes its position in the direction of the Z-axis by the respective contacting positions of the platen support units 36*b* on the platen drive unit guides 33*c*. Therefore, the platen frame 33 moves up or down along the Z-axis according to the drives of the platen drive rotating shafts 36*a*. Incidentally, the platen frame 33 is placed in the highest position in the direction of the Z-axis when the platen support units 36*b* are positioned in parallel with the Z-axis.

And the length of the platen support unit 36*b* along the Z-axis is established so as to set the platen recording paper transport area 31*c* of the platen belt 31 as the transport position of a recording paper from the paper feed unit 10 at the highest position. Furthermore, the length that the platen drive unit guides 33*c* along the Y-axis is set so as to lower the platen frame 33 to a predetermined position along the Z-axis.

The next description is of the image recording unit 40.

The image recording unit 40 is an ink ejection apparatus for ejecting ink onto a recording paper. The image recording unit 40 comprises a plurality of recording head rows 41, a carriage 42 and a head cooling unit 49 as shown by a later described FIG. 5.

First, let the recording head rows 41 be described.

The recording head rows 41 are an aggregation of image recording units for recording an image. The recording head rows 41 are equipped for each color, extending to the same width, or more, as the maximum width of a used recording paper. Incidentally, the image recording unit 40 according to the present embodiment has a total of four recording head rows, i.e., cyan (C), magenta (M), yellow (Y) and black (K) as shown by FIG. 2. And in the image recording unit 40, shown by FIG. 2, a suffix for indicating a corresponding color (i.e., above described C, M, Y or K) is added to a reference sign for indicating each recording head row 41 for description.

Figure 5:
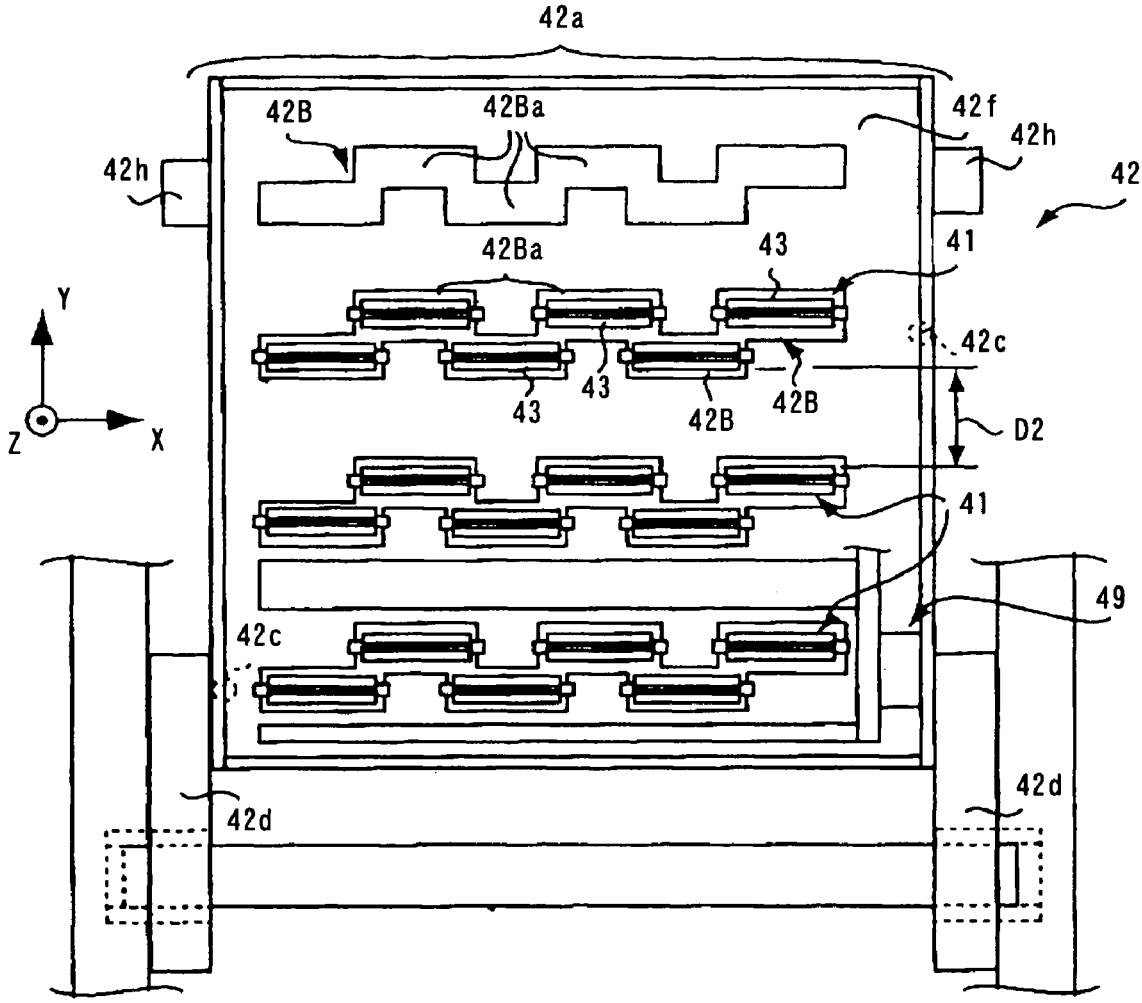
FIG. 5 is an illustrative top view of a carriage.

These recording head rows 41 are supported by a carriage 42 as shown by FIG. 5. FIG. 5 is an illustrative top view of the recording head rows 41 mounted on the carriage 42. Note that in FIG. 5 one recording head row 41 out of the four recording head rows 41 is omitted for the sake of the description. Each recording head row 41 is constituted by placing a plurality of later described recording head units 43 with their longitudinally aligned with one another.

The recording head rows 41 have a size, in the longitudinal direction, of no less than the width of a recording paper, so as to be able to record an image across the entire width of the recording paper when recording an image. That is, if the image recording apparatus 1 accommodates a recording of A3 size recording paper, the width of the recording head rows 41 is set at no less than the width of A3 size recording paper. The recording head row 41 according to the present embodiment comprises six recording head units 43 as shown by FIG. 5.

The next description is of the carriage 42.

The carriage 42 comprises a head mount part 42*a* for mounting the recording head row 41, a carriage holes 42B for exposing a recording head row 41 to a recording paper, a carriage positioning pin 42*c* for positioning the platen unit 30, a pair of paper feed roller linkage units 42*d* and frame contact flanges 42*h*.

Let the head mount part 42*a* be described first.

The head mount unit 42*a* has a head mount surface 42*f* for mounting the recording head row 41, and a recording paper facing surface 42*g* (refer to FIG. 6) which is the opposite surface to the head mount surface 42*f*. The recording paper facing surface 42*g* is the surface facing towards a recording paper at the time of recording an image. The head mount part 42*a* has a longitudinal direction and a width direction. Each recording head row 41 is placed on the head mount part 42*a* so that the longitudinal direction of the recording head row 41 and the width direction of the head mount part 42*a* are practically in line with each other as shown by FIG. 5. Note that these recording head rows 41 are placed so as to maintain a distance D2 (refer to FIG. 5) between a neighboring recording head row 41 along the longitudinal direction of the head mount part 42*a*. Incidentally the present specification refers to the longitudinal and width directions of the head mount part 42*a* as the longitudinal and width directions of the carriage 42. Also, in the description of the present specification, the longitudinal direction is along the Y-axis and the width direction along the X-axis.

Next the carriage holes 42B are described.

The carriage holes 42B are featured in the head mount part 42*a* in accordance with the number of recording head rows 41. The present embodiment is configured to feature four carriage holes 42B. Each carriage hole 42B comprises a plurality of exposure—use holes 42Ba, linked together, of a size allowing each recording head unit 43 to be exposed.

Each exposure-use hole 42Ba is placed in a position corresponding to each recording head unit 43 when the recording head row 41 is correctly positioned. The present embodiment is configured to connect six exposure-use holes 42Ba together to form the each carriage hole 42B which accordingly extends along the X-axis. Therefore, the longitudinal direction of each exposure-use hole 42Ba is also practically in line with the X-axis.

Figure 6:
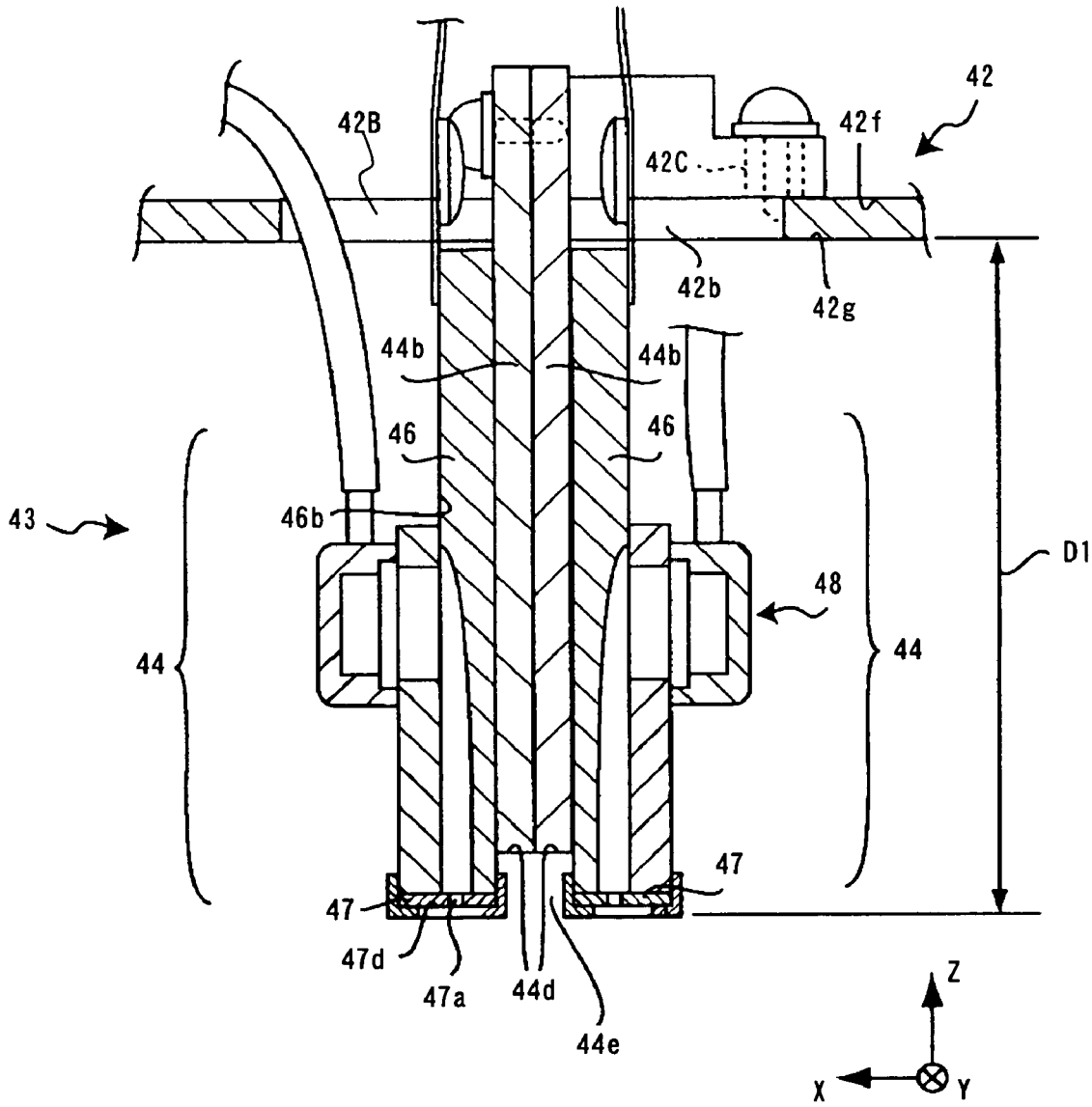
FIG. 6 is a cross-sectional view of an arrangement of recording heads.

And, these carriage holes 42B are arranged in a predetermined interval along the Y-axis so as to achieve the above described location of the recording head rows 41. And the recording head units 43 constituting each recording head row 41 are suspended from the head mount part 42*a* so as to protrude by the distance of D1 along the Z-axis from the carriage holes 42B as shown by FIG. 6. Note that the neighboring recording head rows 41 are separated from each other by the distance of D2. Because of this, a space S (refer to FIG. 2) corresponding to the distance D2 along the Y-axis and distance D1 along the Z-axis and extending along the X-axis is formed between neighboring recording head rows 41. FIG. 2 only shows one space S for clarity. The space S is the area surrounded by the double-dotted lines.

Next, let the carriage positioning pin 42*c* be described.

Figure 7:
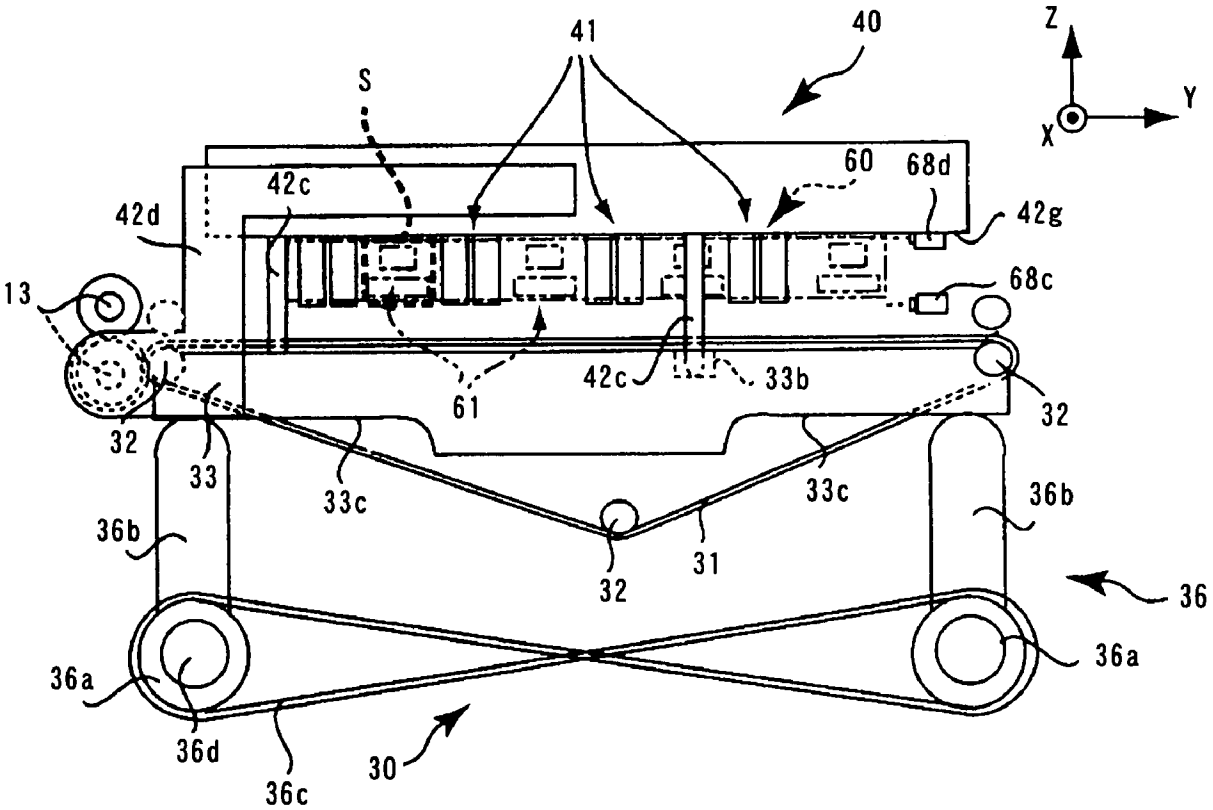
FIG. 7 is an illustrative side view of a carriage and a platen unit.

The carriage positioning pins 42*c* protrude from the recording paper facing surface 42*g* as shown by FIG. 7. The carriage positioning pin 42*c* is configured to be insertable into the platen guide hole 33*b* comprised by the platen unit 30 when the image recording mechanism 20 and the platen unit 30 are positioned in the image recording position (i.e., an image recording position).

More specifically, the carriage positioning pins 42*c* are equipped by the same number of the platen guide holes 33*b* and are placed in a position facing the respective platen guide holes 33*b*. The present embodiment comprises the carriage positioning pins 42*c* equipped in the positions facing the upstream platen guide hole 33*b*_1 and the downstream platen guide hole 33*b*_2, respectively. Specifically, the carriage positioning pin 42*c* facing the downstream platen guide hole 33*b*_2 is placed in a position at the center thereof in the direction of X- and Y-axes. And the each carriage positioning pin 42*c* has a length insertable to the platen guide hole 33*b*. Furthermore, the each carriage positioning pin 42*c* has practically the same diameter as the platen guide hole 33*b*. Incidentally, the end of the each carriage positioning pin 42*c* is featured with a taper (i.e., tapers off).

The next description is of each of the recording head units 43 constituting each of the recording head rows 41.

The recording head unit 43 comprises at least one inkjet head 44. The present embodiment is configured for the recording head unit 43 to comprise two inkjet heads 44 as shown by FIG. 6.

First, let the comprisal of each inkjet head 44 be described.

Each inkjet head 44 comprises apiezoelectric body 46, a head base plate 44*b*, a nozzle plate 47, and a head ink distribution part 48 as shown by FIG. 6.

The inkjet head 44 comprised as described above constitutes the recording head unit 43 by adhering to another inkjet head 44 as shown by FIG. 6. When adhering to each other, the two inkjet heads 44 are adhered by the head base plate 44*b* of each other. In such an assembled inkjet head 44, nozzle forming faces 47*d* of respective nozzle plates 47 are set so as to be positioned on practically the same plane as shown by FIG. 6. At the same time, nozzle-side base plate faces 44*d* of the head base plates 44*b* are placed so as to be flush with each other as shown by FIG. 6.

By the above described configured head base plate 44*b*, the nozzle forming faces 47*d* and two piezoelectric bodies 46 a guide groove 44*e* is formed as shown by FIG. 6. The guide groove 44*e* extends across practically the entire longitudinal direction of the inkjet head 44, thereby guiding a movement of a later described maintenance suction unit of the maintenance unit.

Figure 8:
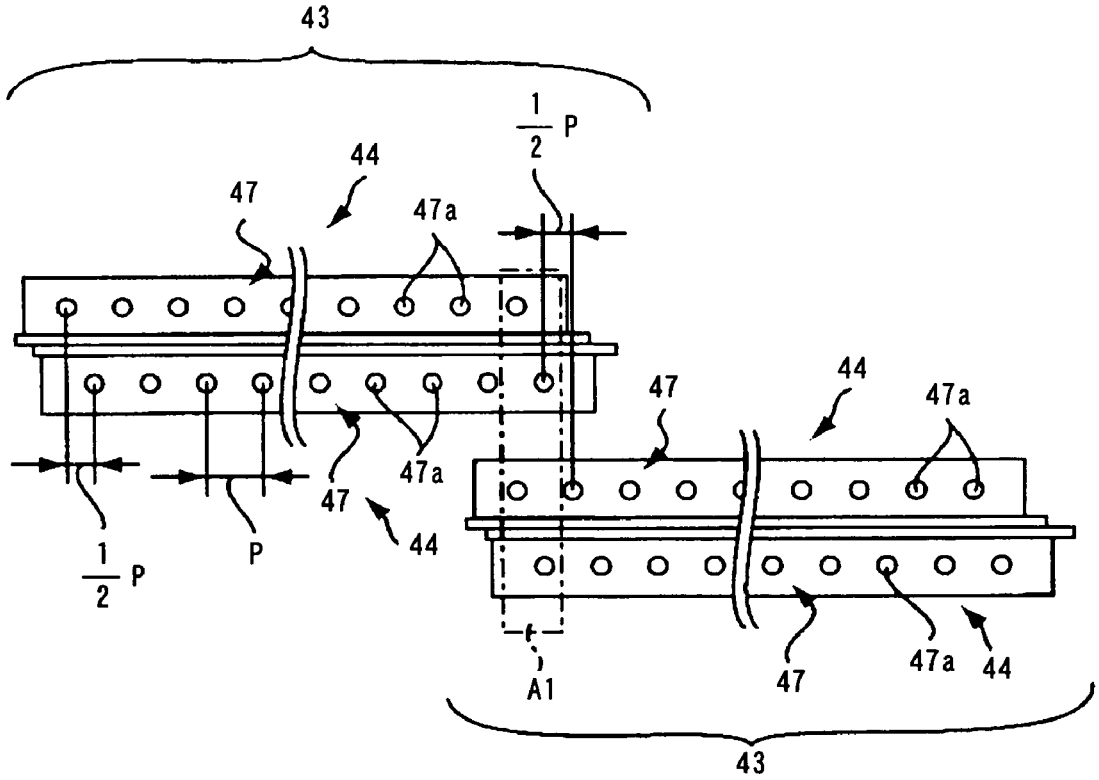
FIG. 8 is an illustration showing recording heads.

And, when the recording head units 43 are assembled, the nozzle row of each inkjet head 44 constituting them is established in parallel with each other as shown by FIG. 8. And the nozzle row of one inkjet head 44 is shifted by a half of the pitch P of the nozzles 47*a* in the direction of the array thereof, vis-à-vis the nozzle row on the other inkjet head 44. This configuration enables the recording head unit 43 to record an image at 360 dpi, twice as much as the inkjet head 44 if it is configured for 180 dpi.

As described above, each recording head unit 43 constitutes the above described recording head row 41, together with other recording head units 43 for each carriage hole 42B when placing the recording head units 43 in the respective exposure-use holes 42Ba. At this point, let the description of the recording head rows 41 be returned to.

Each recording head row 41 comprises a plurality of recording head units 43 arranged in rows as described above. In such recording head rows 41, each recording head unit 43 is placed so as to partially overlap with the adjacent recording head unit 43 in the direction of arranging the recording head units 43 (i.e., the longitudinal direction) as shown by FIG. 8. This configuration makes the nozzles of mutually adjacent recording head units 43 in the arranging direction of the recording head units 43 overlap with each other in the longitudinal direction of the nozzle row.

The overlapping area of adjacent nozzle rows is secured as indicated by the reference sign A1 in FIG. 8, therefore the nozzle row of each recording head row 41 is configured without a gap along the entire longitudinal direction of the recording head row 41. As such the recording head row 41 comprises the nozzles 47*a* of a practically uniform pitch.

[Exit Unit 50]

The next description is of the exit unit 50.

The exit unit 50 is a mechanism for recording paper to exit after recording an image by the image recording mechanism 20. The exit unit 50 comprises an exit unit transport roller pair 51, an exit unit exit roller pair 52, a path changeover unit 53, an exit auxiliary unit 54 and an exit tray 55 as shown by FIG. 2.

[Maintenance Unit 60]

Figure 9:
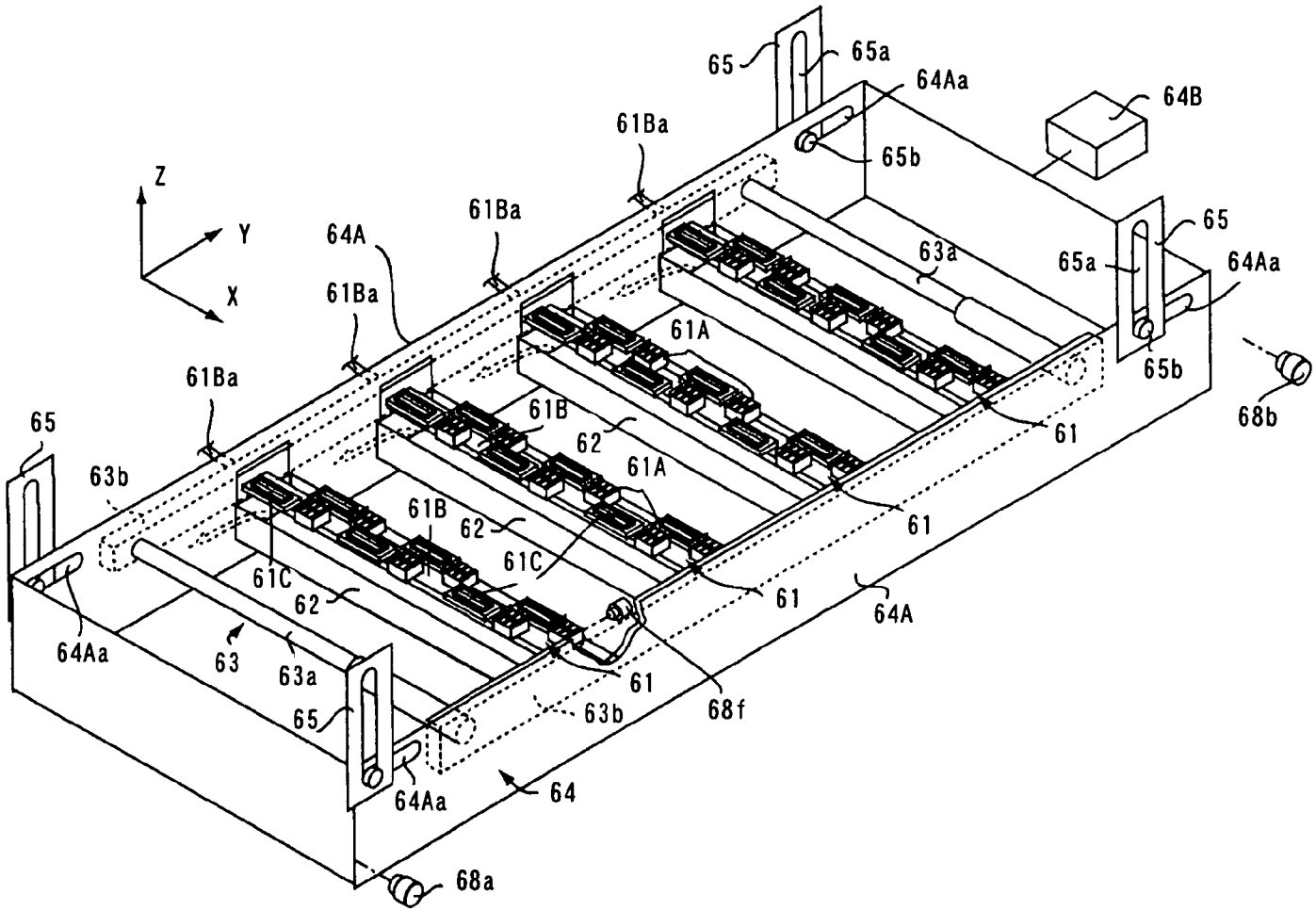
FIG. 9 is a diagonal view of a maintenance unit.

The maintenance unit 60 comprises a plurality of maintenance units 61, a plurality of maintenance ink pans 62, a maintenance unit drive unit 63, a transport direction guide frame 64, four elevator guide frames 65, a positional detection units 68*a* and 68*b* as shown by FIG. 9.

First, let the maintenance units 61 be described.

The maintenance units 61 are equipped so as to correspond to the positions of the four recording head rows 41. Specifically, the maintenance units 61 are arranged by being separated from one another by a predetermined distance in the direction of the Y-axis as with the arrangement of the recording head rows 41. Each maintenance unit 61 has a plurality of maintenance suction units 61A and cap units 61C. Specifically, each maintenance unit 61 has a plurality of maintenance suction units 61A and cap units 61C, both of which are arranged along the X-axis. The present embodiment is configured so that each maintenance unit 61 has the same number of maintenance suction units 61A and cap units 61C as the number of the recording head units 43 constituting each recording head row 41, i.e., six, respectively.

The each maintenance unit 61 has a base plate 61B for holding six maintenance suction units 61A. Each base plate 61B is fixed to the maintenance unit drive unit 63 and extends along the X-axis. On the base plate 61B, each of six maintenance suction units 61A and six cap units 61C are respectively arranged in the same way as the recording head units 43 constituting the above described each recording head row 41. That is, when the maintenance units 61 are positioned vis-à-vis the recording head rows 41 at the time of a later described maintenance, the each maintenance suction unit 61A is placed in the position facing the corresponding recording head unit 43. Note that the six maintenance suction units 61A are placed in the same position as the six cap units 61C in the direction of the Y-axis, but displaced in the direction of the X-axis on the base plate 61B as shown by FIG. 9.

The each base plate 61B is also connected, by way of a suction tube 61Ba, to a suction pump (not shown herein) for providing a suction force for the each maintenance suction unit 61A at the time of maintenance. And the base plate 61B has a flow path (not shown herein) for connecting the suction tube 61Ba and each maintenance suction unit 61A. Therefore, the each maintenance suction unit 61A performs suction when the suction pump is attains a negative pressure.

Next, let the maintenance ink pans 62 be described.

The maintenance ink pan 62 is an ink receiving pan for preventing ink splatter at the time of maintenance. The maintenance ink pans 62 are respectively equipped for the same number of maintenance units 61 and placed in positions corresponding to the respective maintenance units 61.

Specifically, the each maintenance ink pan 62 is equipped on the opposite side of a recording head row 41 across the maintenance unit 61 in the direction of Z-axis. The present embodiment is configured to equip the maintenance ink pan 62 below each maintenance unit 61. The size of the maintenance ink pan 62 along the X- and Y-axes is set to be the same, or greater than, that of the maintenance unit 61. Each maintenance ink pan 62 is set for the position vis-à-vis the maintenance unit 61 in the X- and Y-axes so as to be able to accommodate the maintenance unit 61. Also, the maintenance ink pan 62, while being described later, is set to a size in the direction of Y-axis so as to be able to take shelter in the above described space S between the recording head rows 41 at the time of recording an image. Specifically, the size of the maintenance ink pan 62 in the Y-axis is set to be smaller than the distance D2.

And the maintenance ink pan 62 is fixed to the maintenance unit drive unit 63. The maintenance ink pan 62 is set at the placement on the Z-axis at the time of the above described fixing so as to be able to take shelter in the above described space between the recording head rows 41. Specifically, the maintenance ink pan 62 is placed so that the position of the lower end thereof (i.e., the end on the opposite side vis-à-vis the recording head row 41) is a distance of greater than D2 from the upper end of the transport direction guide frame 64 in the Z-axis direction. Therefore, when the upper edge of the transport direction guide frame 64 comes into the proximity of the recording paper facing surface 42*g*, the maintenance ink pan 62 is never positioned below the edge of the recording head row 41 at the time of recording an image.

The next description is of the maintenance unit drive unit 63.

The maintenance unit drive unit 63 holds all the maintenance units 61 as described above. Specifically, the maintenance unit drive unit 63 has a pair of unit retention frames 63*b* which extend along the Y-axis, thereby retaining each maintenance unit 61 from both ends along the X-axis. And the maintenance unit drive unit 63 has a pair of suction unit drive mechanisms 63*a* for making a unit retention frame 63*b* driven along the X-axis. The pair of suction unit drive mechanisms 63*a* fixedly supports the unit retention frame 63*b* at the front in terms of the drive direction. And the unit retention frame 63*b* on the rear side in terms of the drive direction is supported by the suction unit drive mechanisms 63*a* in a slidable manner. Therefore, the suction unit drive mechanisms 63*a* press the unit retention frame 63*b* on the front side along the X-axis at the time of driving, thus resulting in making all the maintenance units 61 driven along the X-axis.

Note that the X-axis is the direction of a nozzle array on the each of the inkjet heads 44. Therefore, the pair of suction unit drive mechanisms 63*a* is a maintenance suction unit drive mechanism for making the maintenance suction unit 61A move along the nozzle row of the corresponding inkjet head 44. The pair of suction unit drive mechanisms 63*a* is configured to make at least the maintenance unit drive unit 63 movable across the entirety of the inkjet head 44 in the direction of the nozzle row.

And when positioning the maintenance unit 61 at one end of the driving range along the X-axis, the suction unit drive mechanisms 63*a* are placed in the position facing the recording head unit 43 that each cap unit 61*c* corresponds to. The present specification defines the aforementioned position of the maintenance unit 61 as the home position thereof.

The pair of suction unit drive mechanisms 63*a* is connected to the control unit 90 which controls the drive. Incidentally, the maintenance unit drive unit 63 per se is supported in a movable manner vis-à-vis the transport direction guide frame 64 in the Y-axis direction, hence making it possible to make all the maintenance units 61 move in the Y-axis direction as a result of the maintenance unit drive unit 63 moving in the Y-axis direction.

The following descriptions are of the transport direction guide frame 64 and the elevator guide frames 65.

The transport direction guide frame 64 has a pair of side walls 64A along the Y-axis. Both ends of each side wall 64A are featured with a transport direction guide groove 64Aa along the Y-axis. And the transport direction guide frame 64 has a slide mechanism 64B for providing driving power along the Y-axis. The slide mechanism 64B is connected to the control unit 90 which controls the drive.

The four elevator guide frames 65 are support members for supporting the transport direction guide frame 64 movably. These elevator guide frames 65 are fixed to a frame (not shown herein) of the recording apparatus 1. Each of the elevator guide frames 65 is placed in a position corresponding to the transport direction guide groove 64Aa.

And each elevator guide frame 65 has an elevator guide groove 65*a* along the Z-axis. And the each elevator guide groove 65*a* is positioned with the corresponding transport direction guide groove 64Aa, and is linked with the transport direction guide groove 64Aa by a link member such as a pin 65*b* which is inserted so as to pass through these grooves. By this configuration, the elevator guide frame 65 supports the transport direction guide frame 64 movably along the Y- and Z-axes as shown by FIG. 9. Incidentally, drive power is provided to the transport direction guide frame 64 by a slide mechanism 64B, thus allowing it to move along the Y-axis.

And the transport direction guide frame 64 is pressed by the platen frame head facing surface 33*a* when the platen frame 33 moves upward as noted in the above description of the platen unit 30. By this configuration, the transport direction guide frame 64 moves in the Z-axis direction in accordance with a vertical movement of the platen frame 33. As such, since the transport direction guide frame 64 moves with the platen frame 33, the size of the transport direction guide frame 64 in the Z-axis is set up so as not to obstruct the movement of the platen frame 33. In other words, the size of the transport direction guide frame 64 along the Z-axis is set so as not to contact the carriage 42 when the platen frame 33 moves to a desired position on the Z-axis.

And the size of the transport direction guide frame 64 in the Z-axis is set so that the platen unit 30 is placed in the transporting position (i.e., an image recording position) of a recording paper at the time of recording an image when the upper end of the transport direction guide frame 64 is in contact with, or in proximity to, the recording paper facing surface 42*g*.

By this configuration, when being guided to one end of the transport direction guide groove 64Aa along the Y-axis, the transport direction guide frame 64 is placed in a Y-axis suction setup position, while when being guided to the other end, the transport direction guide frame 64 is placed in a Y-axis retracted position. The Y-axis suction setup position is the position where the maintenance unit 61 comes to the same position as the recording head unit 43. In the Y-axis suction setup position, each maintenance unit 61 faces each inkjet head 44. Incidentally, the transport direction guide frame 64 shown by FIG. 9 is positioned at the Y-axis suction setup position along the Y-axis.

The above described Y-axis retracted position is the position where the maintenance unit 61 comes to the same position as the space S along the Y-axis. That is, the Y-axis retracted position is the position along the Y-axis where the maintenance unit 61 does not interfere with the recording head unit 43 even when the maintenance unit 61 moves along the Z-axis.

And when being guided to one end (i.e., the lower end as shown by FIG. 9) of the elevator guide groove 65*a* along the Z-axis, the transport direction guide frame 64 is positioned at a Z-axis movable position, while when being moved to the other end (i.e., the upper end as shown by FIG. 9), the transport direction guide frame 64 is placed at a Z-axis retracted position. The Z-axis movable position is the position where the transport direction guide frame 64 does not interfere with the recording head unit 43 in the Z-axis direction. Therefore, the transport direction guide frame 64 is movable along the transport direction guide groove 64Aa in the Z-axis movable position.

The aforementioned Z-axis retracted position is the position where the transport direction guide frame 64 is in the same position as the space S in the Z-axis. When the transport direction guide frame 64 is placed in the Y-axis retracted position on the Y-axis and in the Z-axis retracted position on the Z-axis, each of the maintenance units 61 is placed within the applicable space S as shown by FIG. 7.

Note that the present embodiment is configured to provide the drive power to the transport direction guide frame 64 from the platen frame 33, but it is possible to provide the drive power by other independent drive means.

The next description is of the positional detection units 68 (i.e., 68*a* and 68*b*).

The positional detection units 68 are means for detecting the position of the maintenance unit 60. The positional detection units 68 comprises a Y-axis suction position sensor 68*a* (refer to FIG. 9), a Y-axis retracted position sensor 68*b* (refer to FIG. 9), a Z-axis suction position sensor 68*c* (refer to FIG. 7), a Z-axis retracted position sensor 68*d* (refer to FIG. 7) and an X-axis home position sensor 68*f* (refer to FIG. 9). These sensors are connected to the control unit 90 and transmit the respective detection result thereto.

[Paper Guide Unit 100]

The next description is of the paper guide unit 100.

Figure 1:
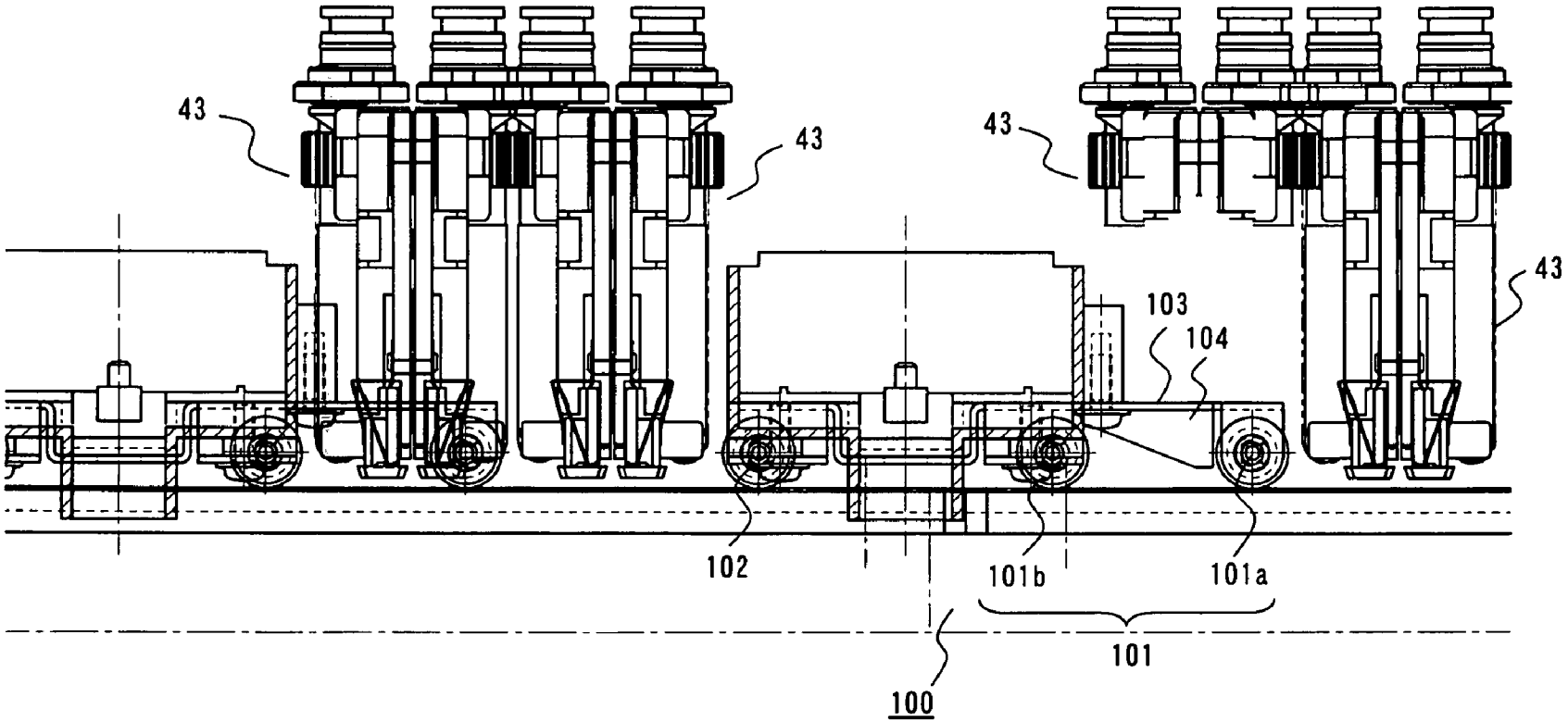
FIG. 1 is a cross-sectional view of a paper guide unit.
Figure 10:
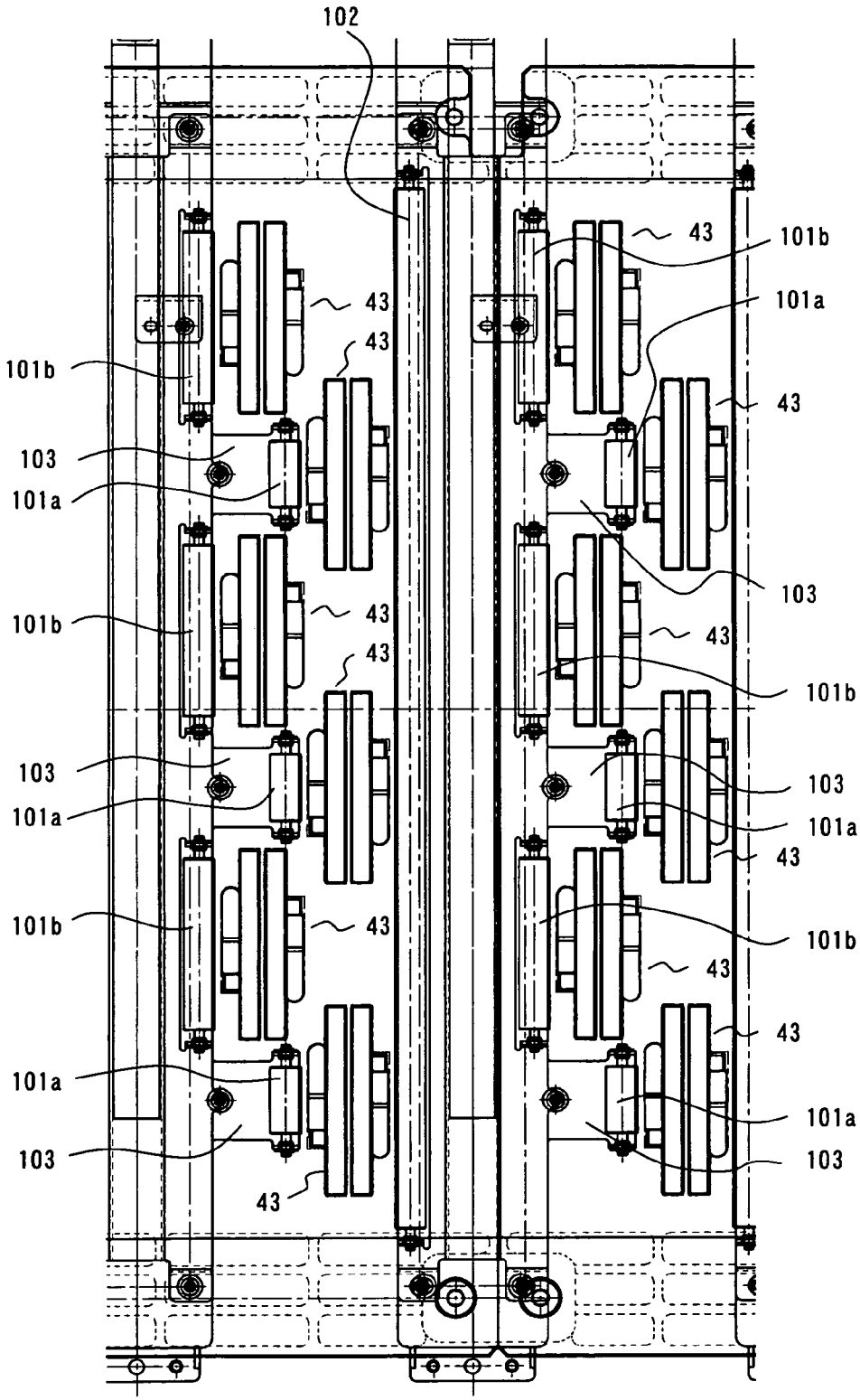
FIG. 10 is an illustrative top view of a paper guide unit.
Figure 11A:
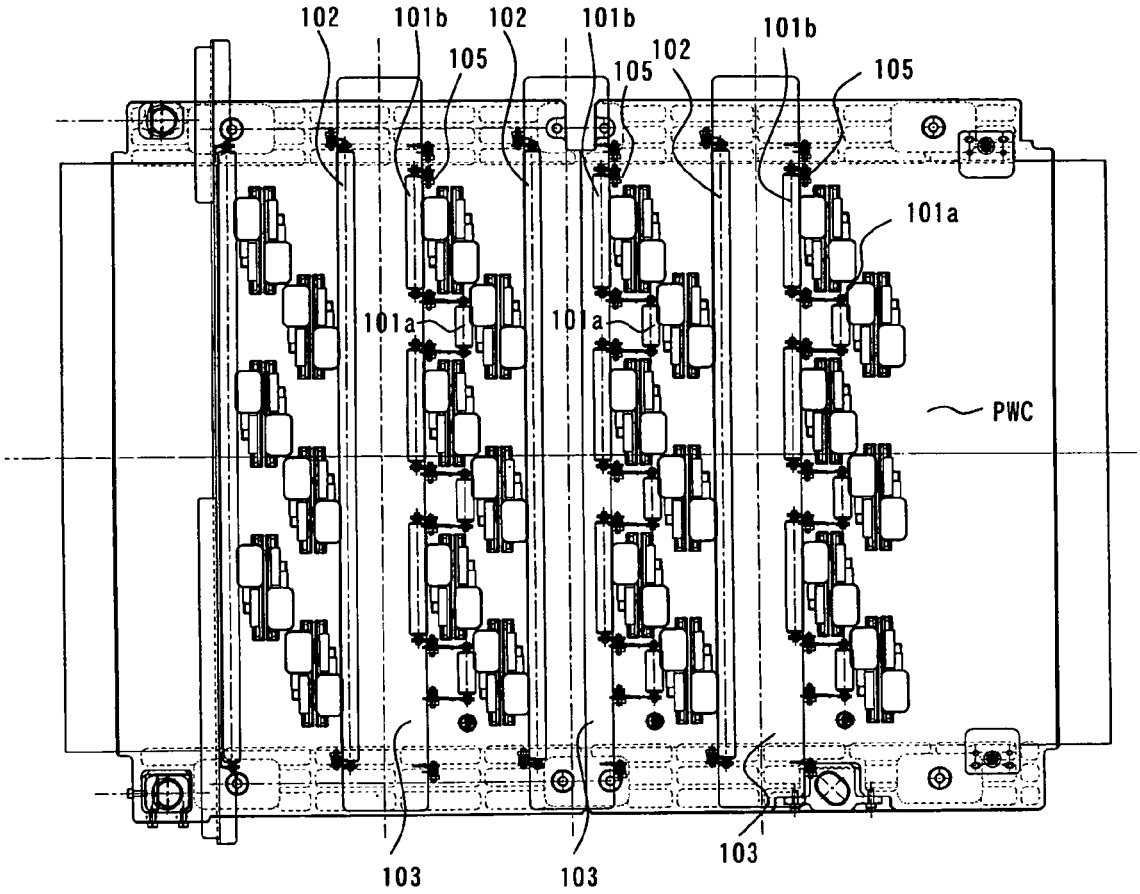
FIG. 11A is an illustrative top view of a paper guide unit and FIG. 11B a cross-sectional view thereof.
Figure 11B:
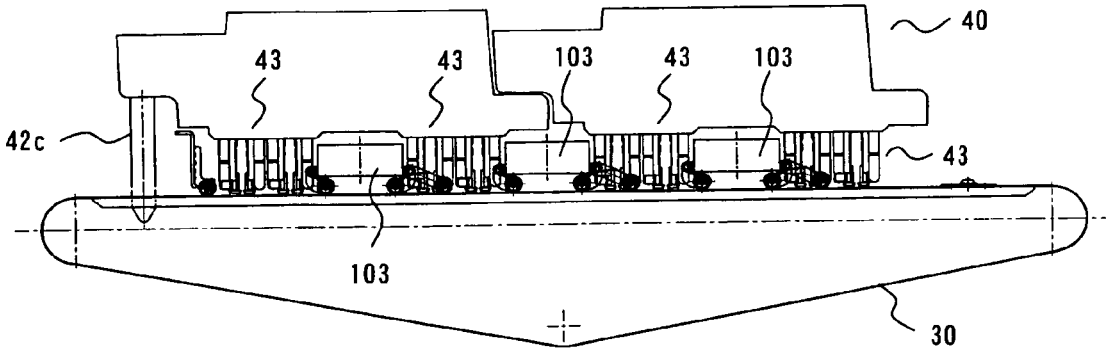

The paper guide unit 100 comprises guide rollers 101 and 102, a paper guide frame 103, a paper guide rib 104 as shown by FIGS. 1, 10 and 11. Incidentally, FIG. 11A is an illustrative top view of a paper guide unit and FIG. 11B a cross-sectional view thereof.

The paper guide frame 103 is set up for the distance between the platen belt 31 accurately as a result of a positioning unit (not shown herein) coming into contact with the platen frame 33 of the platen unit 30 underneath the above described maintenance ink pan 62 of the maintenance unit 60.

The guide roller 101 is equipped upstream of the recording paper transport direction of the recording head unit 43 and is rotationally supported by the paper guide frame 103 either in contact with the platen belt 31 or at a predetermined distance therefrom.

A guide roller 101*a* is equipped for the recording head unit 43 (NB: shown by a recording head 43) positioned downstream of the recording paper transport direction among the head rows arrayed in a plurality of checkered patterns in the width direction of a recording paper, while a guide roller 101*b* is equipped for the recording head unit 43 positioning itself in the upstream of the recording paper transport direction.

The guide roller 101*b* is a roller of a split type having the same width as the recording head 43 positioned upstream with respect to the recording paper transport direction. Note that the guide roller 101*b* may be configured by a single roller placed across the entire width of a recording paper.

The guide roller 102 is equipped downstream with respect to a recording paper transport direction of the recording head 43 and is rotationally supported by the paper guide frame 103 so as to contact the platen belt 31. The guide rollers 101*a* and 101*b* are respectively supported by the paper guide frames 103 in a slidable manner in the Z direction, thereby securing firmly the contact between the guide roller 101 and the platen belt 31 even if flatness is not adequately secured by the platen frame 33 of the platen unit 30 such as in the case of the platen frame 33 being convex or concave, because each roller slides in the Z direction following the form of the platen frame 33.

The surfaces of the guide rollers 101 and 102 are treated by an ink repellent process such as fluoroplastic coating or silicone coating to prevent the ink from being transferred to the roller circumference as a result of contacting the printing face of a recording paper or the platen belt 31. That is, once a contaminant such as ink is transferred onto the roller circumference, the contact of the guide rollers 101 or 102 with the recording paper surface which is transported subsequently transfers the ink onto the recording paper surface, thereby causing a contamination of the recording paper or a degradation of image quality. The above described processing prevents such problems.

Figure 12B:
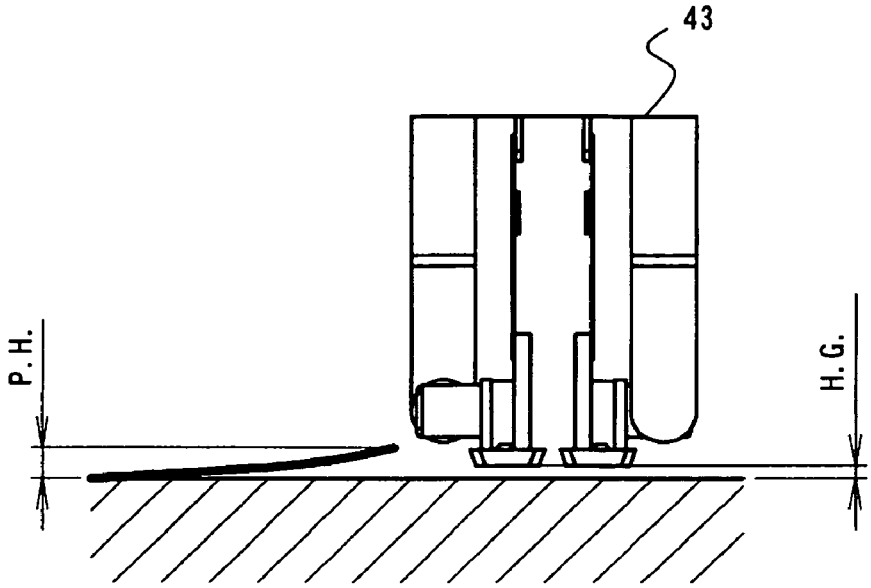
FIG. 12A describes a configuration of a paper guide rib and FIG. 12B describes a state of recording paper curling.
Figure 12A:
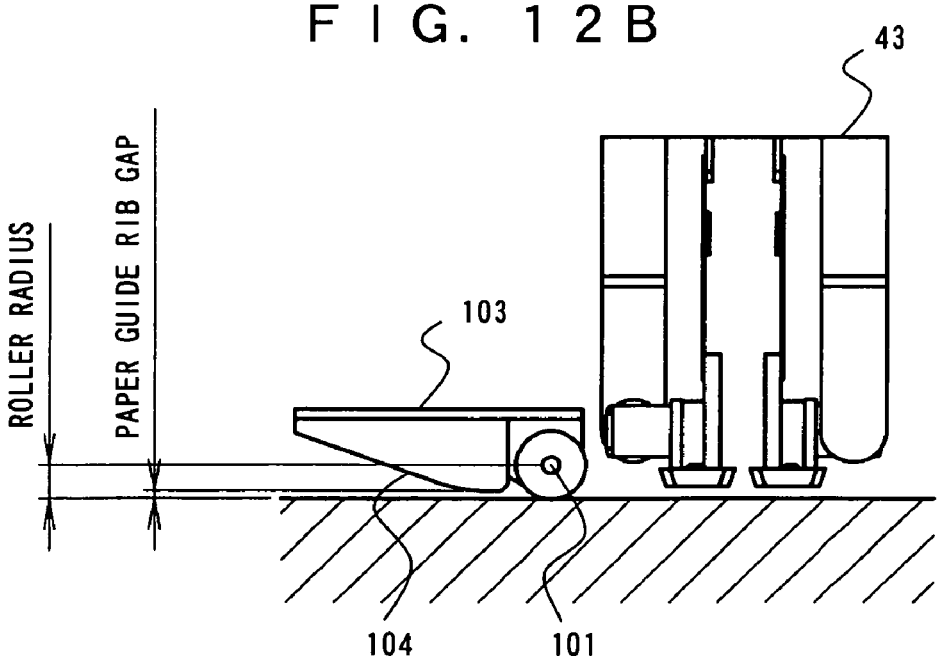

The surface of the paper guide frame 103 facing the platen belt 31 is equipped by a paper guide rib 104. The configuration is such that the paper guide rib 104 is equipped upstream with respect to the recording paper transport direction of the guide roller 101 as shown by FIG. 12A, and the distance to the platen belt 31 is large in the upstream of the recording paper transport direction, with the aforementioned distance gradually becoming smaller towards the downstream of the recording paper transport direction and that the distance to the platen belt 31 becomes smaller than the radius of the guide roller 101 at the point that the aforementioned distance becomes the smallest.

Figure 13A:
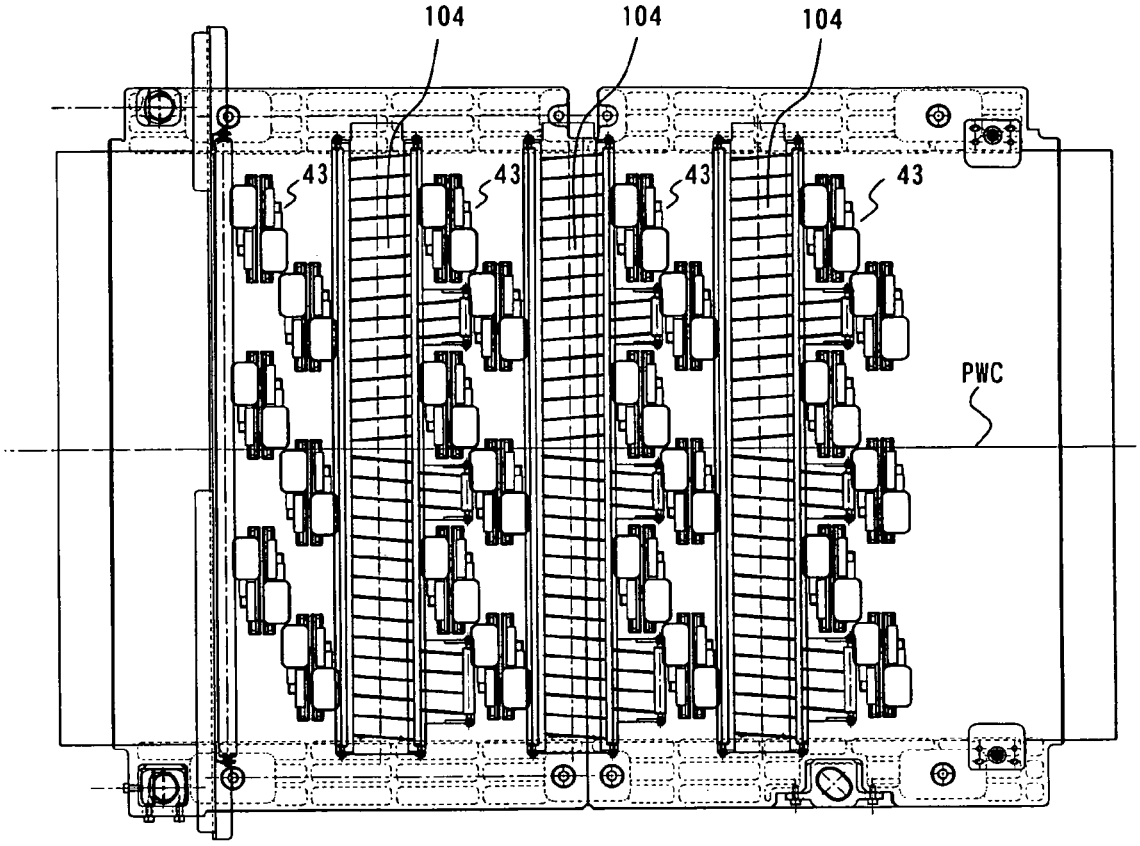
FIG. 13A is a top view describing a configuration of a paper guide rib and FIG. 13B a cross-sectional view thereof.
Figure 13B:
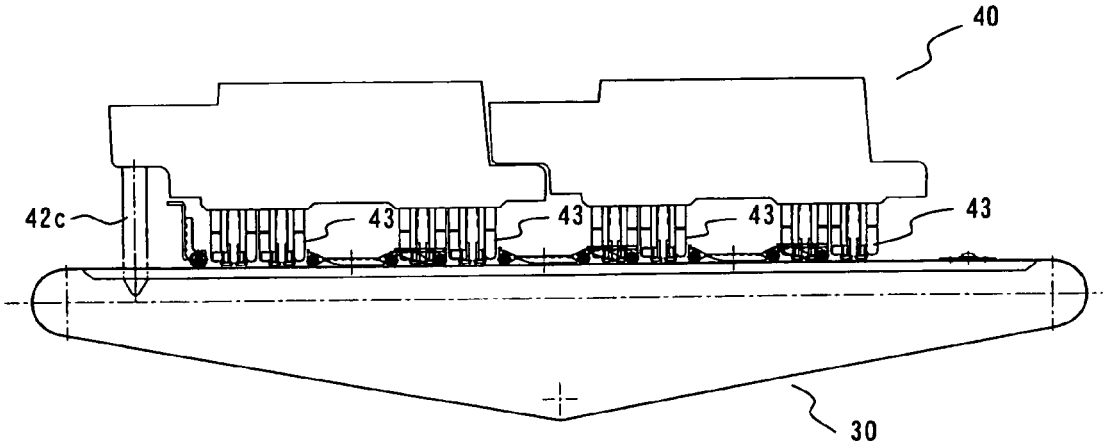

Incidentally, the paper guide rib 104 is configured to position itself on the outside of a recording paper width direction for the downstream as compared to the upstream of the recording paper transport direction as shown by FIG. 13. Such a configuration of the paper guide rib 104 reverses along the width direction from one side to the other side of the center position of the recording paper width direction PWC.

And the guide rollers 101 and 102 are equipped with guide roller springs 105 (refer to FIG. 11), thereby forcing them against the platen belt 31 with a predetermined force in addition to the respective inherent weight of the guide rollers 101 and 102.

If a recording paper with a curl or wrinkle is transported to the image recording mechanism 20, the recording paper in many cases is sucked onto the platen belt 31 by the suction force of the platen unit 30, thereby suppressing an uplift amount PH of the recording paper from the platen belt 31 no more than the distance HG (i.e., a head gap) between the lowest surface of the recording head 43 and the upper surface of the platen belt 31. However, some recording papers with a large curl or wrinkle uplift by an amount PH no less than the head gap HG even with the suction of the platen unit 30 as shown by FIG. 12B.

Such a recording paper is pressed down at its leading edge by the paper guide rib 104 of the paper guide unit 100 and therefore the uplift amount PH of the leading edge of the recording paper becomes no more than the radius of the guide roller 101 when the leading edge of the recording paper reaches the neighborhood of the guide roller 101, thereby being pressed down to the platen belt 31 smoothly by the guide roller 101.

The recording paper pressed against to the platen belt 31 by the guide roller 101 has an uplift amount PH becoming larger as the leading edge thereof leaves the nip point of the guide roller 101, but by the time the uplift amount PH becomes larger than the head gap HG, the leading edge of the recording paper has passed the bottom surface of the recording head 43, and therefore the recording paper never comes into contact with the recording head, thus enabling a printing and feeding of the paper.

Meanwhile, when using a recording paper with a large curl or wrinkle causing an uplift amount PH to exceed the head gap HG, the trailing edge of the recording paper can possibly come into contact with the recording head 43. The trailing edge of the recording paper, however, does not come into contact with the recording head 43 because the trailing edge of the recording paper is forced down onto the platen belt 31 by the guide roller 102, thus enabling a printing and feeding of the paper.

The paper guide unit 100 is placed so as to accommodate, by a pair thereof, each of the recording head rows 41 arranged in the sequence of K, C, M, and Y in the recording paper transport direction. Such a placement makes it possible to force down securely a recording paper with a curl onto the platen belt 31 immediately in front of the each recording head.

Meanwhile, in the case of printing in a high temperature and high humidity environment, a recording paper absorbs moisture from its edges and swells. In such an event, the difference in moisture absorption conditions (that is, nearby edges absorb a greater amount of moisture, thus causing more swelling, than the central parts) generates wrinkles mainly near the edges of a recording paper.

The mechanism of wrinkle generation due to such swelling is basically the same as the mechanism of wrinkle generation due to permeation of ink into a recording paper.

This kind of wrinkle cannot be eliminated simply by pressing down with a roller, et cetera, because it is a wrinkle generated due to the difference in the degree of swelling within a recording paper.

Figure 14A:
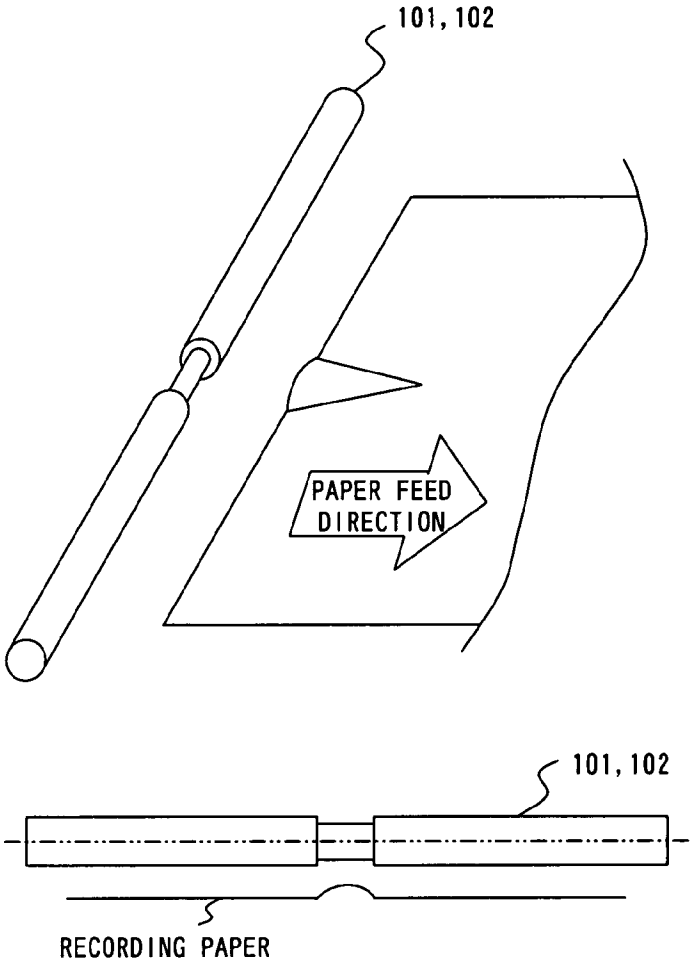
FIG. 14A and FIG. 14B describes a configuration of a paper guide roller.
Figure 14B:
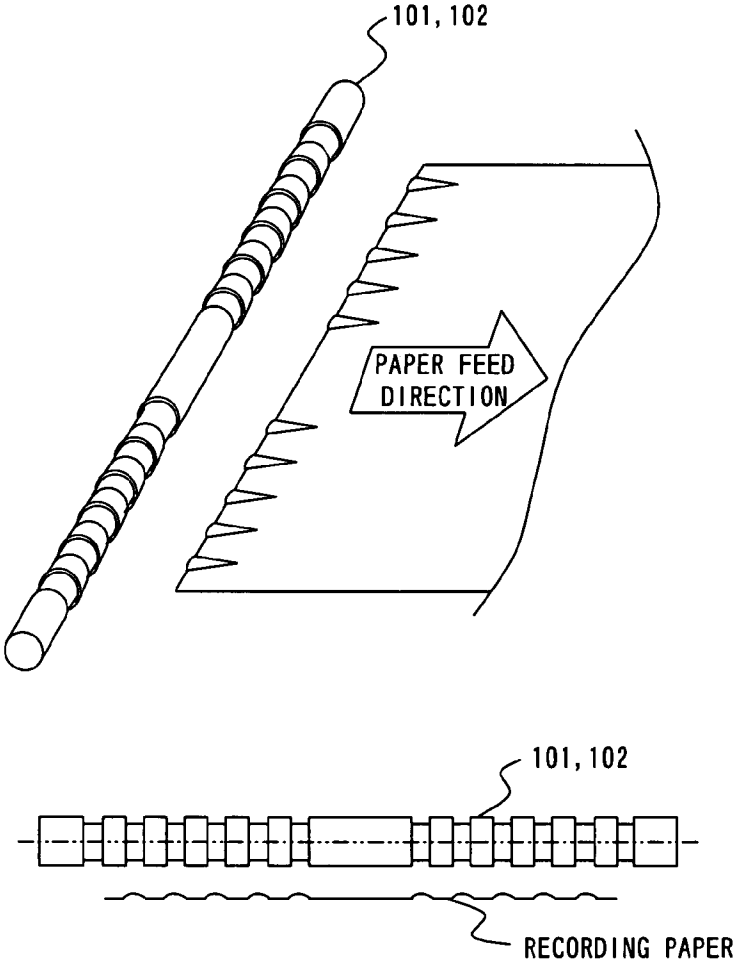

Accordingly, the guide rollers 101 and 102 are featured with one or a plurality of grooves on its circumference as shown by FIG. 14A and FIG. 14B, thereby distributing wrinkles caused by moisture absorption or ink permeation in order to reduce the height of wrinkles as a whole, or thereby gather wrinkles in a small part where wrinkle generation causes relatively small adverse effect, and enabling the prevention of failure occurrence such as a printing head coming into contact with a recording paper due to a wrinkle.

[Control Unit 90]

Figure 15:
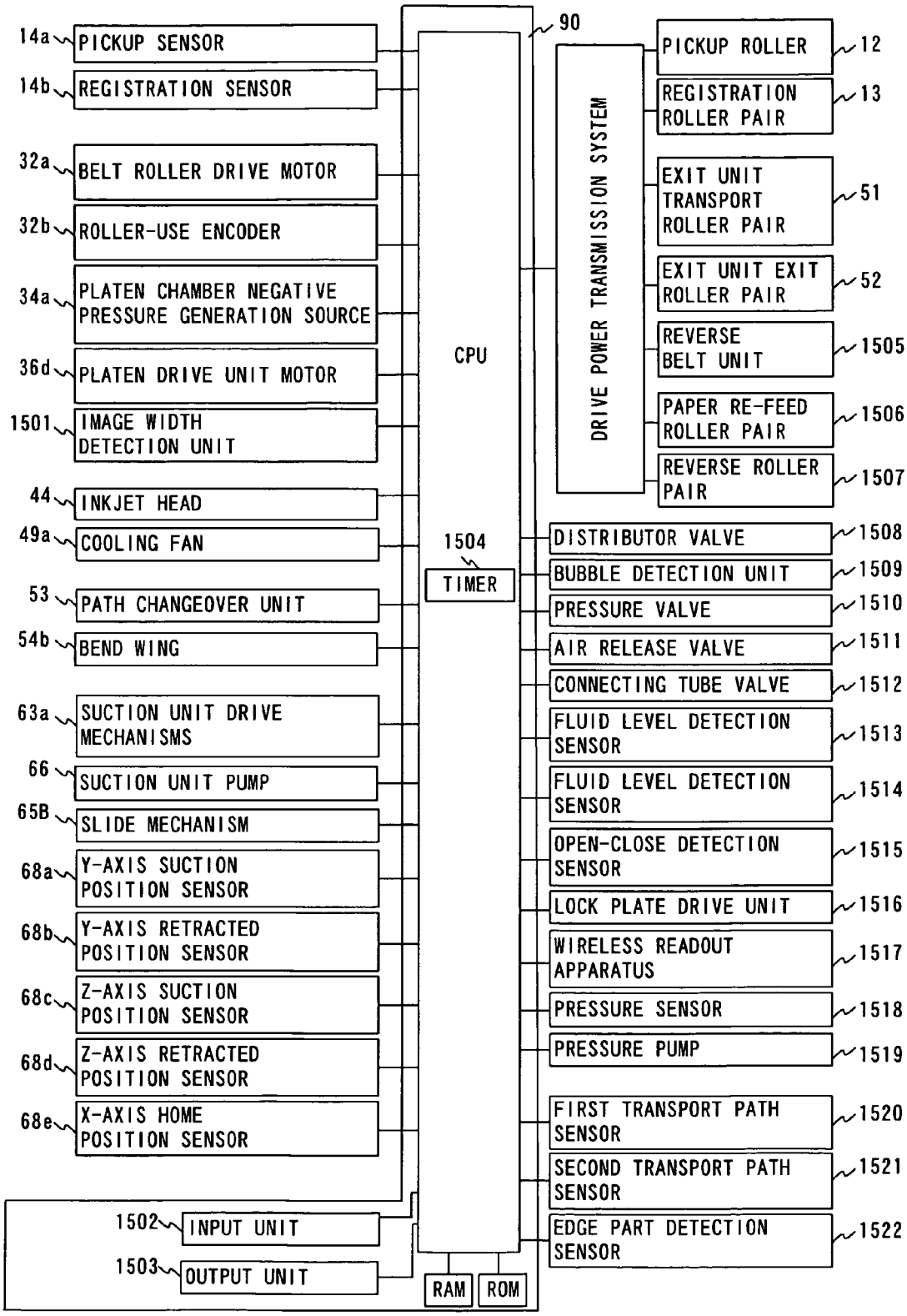
FIG. 15 is a circuit block diagram of a control unit.

The control unit 90 is constituted by a computer including a CPU, timer, ROM, RAM, et cetera as shown by FIG. 15. The control unit 90 is connected to the above described paper feed unit 10, image recording mechanism 20, exit unit 50, maintenance unit 60, ink supply unit 70 and recording paper inversion unit 80, respectively, controlling the driving of the aforementioned components.

More specifically, the control unit 90 is connected to the pickup sensor 14*a* and registration sensor 14*b* in the paper feed unit 10. The control unit 90 controls the drives of the pickup roller 12 and the registration roller pair 13 by way of the drive power transmission system.

The control unit 90 is also connected to the belt roller drive motor 32*a*, roller-use encoder 32*b*, platen chamber negative pressure generation source 34*a*, platen drive unit motor 36*d* and image width detection unit, and controls the aforementioned components.

The control unit 90 is also connected to the recording head 43, cooling fan 49*a*, path changeover unit 53, bend wing 54*b*, suction unit drive mechanism 63*a*, suction unit pump 66 and slide mechanism 65B, and controls the aforementioned components.

The control unit 90 is further connected to respective sensors 68*a* though 68*e* of the position detection unit, and respective pieces of positional information are sent over from these sensors. And the control unit 90 is connected to various rollers such as the exit unit exit roller pair 52, various valves, pumps, et cetera, and carries out the respectively corresponding controls.

[Operation]

The next description is of an operation of the image recording apparatus 1 configured as described above.

First, when recording an image by the image recording apparatus 1, the control unit 90 receives an input of image data by way of an interface (not shown herein). Then the control unit 90 carries out an image recording process based on the input image data.

In this event, the control unit 90 outputs a drive instruction to the slide mechanism 65B and platen drive unit motor 36*d* to let the image recording apparatus 1 retract the maintenance unit 60. And the control unit 90 confirms the retraction of the maintenance unit 60 by way of the Z-axis retracted position sensor 68*d* and Y-axis retracted position sensor 68*b*.

Following the maintenance unit 60 completing a retraction, recording paper pickup is initiated. The control unit 90 outputs a drive instruction to the drive power transmission system so as to turn on a clutch and rotate the pickup roller 12.

The pickup roller 12 picks up a recording paper from the recording paper tray 11 to transport it to the registration roller pair 13 along the recording paper transport direction.

Then, in a predefined time after receiving a detection signal from the registration sensor 14*b*, the control unit 90 starts driving the registration roller pair 13. By so doing, the recording paper is transported to the area of the image recording mechanism 20.

Also in the image recording process, the control unit 90 outputs a drive instruction to each platen chamber negative pressure generation source 34*a* of the platen unit 30 before a recording paper is transported from the paper feed unit 10. Also in this event, the control unit 90 outputs a drive instruction to the belt roller drive motor 32*a* to drive the platen belt 31.

When a recording paper is transported from the paper feed unit 10 to the image recording mechanism 20 (i.e., at the beginning of a transportation), the leading edge of the recording paper is sucked and retained by the platen belt 31. This prevents the recording paper from lifting up from the platen belt 31. The sucked and retained recording paper is moved along in the recording paper transport direction by the platen belt 31 at a predetermined speed.

Then, when the leading edge of the recording paper is transported to the position that faces the recording head row 41, the control unit 90 outputs an image recording instruction to the image recording unit 40. By so doing, each inkjet head 44 starts ejecting ink onto the recording paper. The ink ejection is carried out by each recording head row 41 which extends across the entire width of the recording paper, and therefore a single ejection is capable of recording over the entire width. The platen unit 30 transports the recording paper along the Y-axis in association with the image recording. By this processing the image is recorded sequentially in the longitudinal direction of the recording paper.

In this event, the leading edge of the recording paper is pressed down by the paper guide rib 104 of the paper guide unit 100 so that that the lifting amount PH of the leading edge of the recording paper becomes no more than the radius of the guide roller 101 when the leading edge of the recording paper reaches the neighborhood of the guide roller 101, thereby being pressed down onto the platen belt 31 smoothly by the guide roller 101 in the present embodiment.

The recording paper pressed down onto the platen belt 31 by the guide roller 101 has a lifting amount PH becoming larger as the leading edge leaves the nip point of the guide roller 101, but the leading edge of the recording paper passes through the bottom surface of the recording head 43 before the lifting amount PH becomes larger than the head gap HG. Therefore, even in the case of a recording paper with a large curl or wrinkle, the lifting amount PH of the recording paper is no more than the head gap HG, hence feeding the recording paper without coming into contact with the recording head.

Then, as the recording paper passes through all the recording head rows 41, the image recording is completed. As described above, the image recording apparatus according to the present embodiment is configured to place the guide rollers 101 and 102 in upstream and downstream of the recording head, respectively, for each recording head which is placed in the entire recording area, thereby preventing a recording paper from coming in contact with the recording head even if the recording paper has a curl, wrinkle or cockling. This makes it possible to record on, and transport, the recording paper without allowing an occurrence of a paper jam or an ink contamination on the recording paper.

It is also configured to place the paper guide rib 104 upstream of each guide roller so that the distance to the platen belt 31 at the narrowest point is smaller than the radius of the paper guide roller 101, thereby making it possible to press a large curl, larger than the radius of the guide roller 101, down onto the platen belt without riding up the guide roller 101.

Also in a configuration which places a plurality of recording heads in a checkered pattern in the width direction of the recording paper, guide rollers are divided correspondingly and they are placed immediately before the recording head 43 corresponding thereto as guide rollers 101*a* and 101*b*. Because of this, the distance between each of the respective separate recording heads 43 and the guide roller 101*a* or 101*b*, hence a recording paper with a curl, et cetera, does not come into contact with the recording head 43.

Furthermore, a plurality of rollers is movable up and down against the belt platen independently. This makes the rollers move along the protrusions and indentations of the belt platen surface and recording paper and therefore a curled leading edge of a recording paper of various thickness or size can be pressed down onto the belt platen.

Figure 16A:
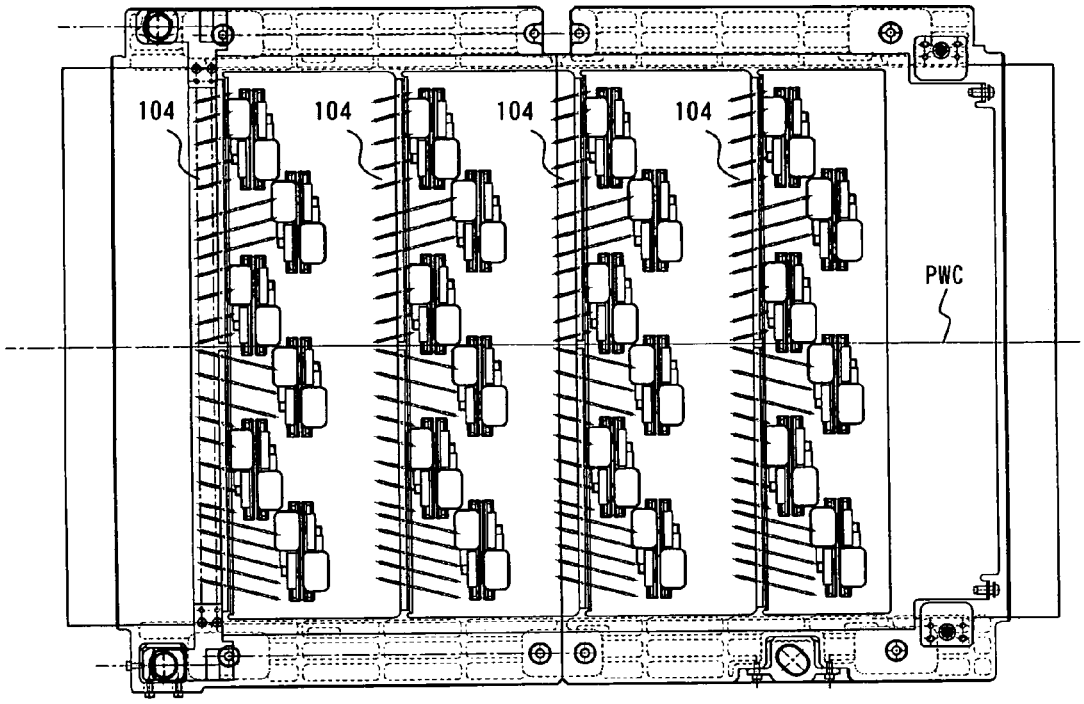
FIG. 16A is an illustrative top view of a paper guide for describing a second embodiment and FIG. 16B a cross-sectional view of the paper guide.
Figure 16B:
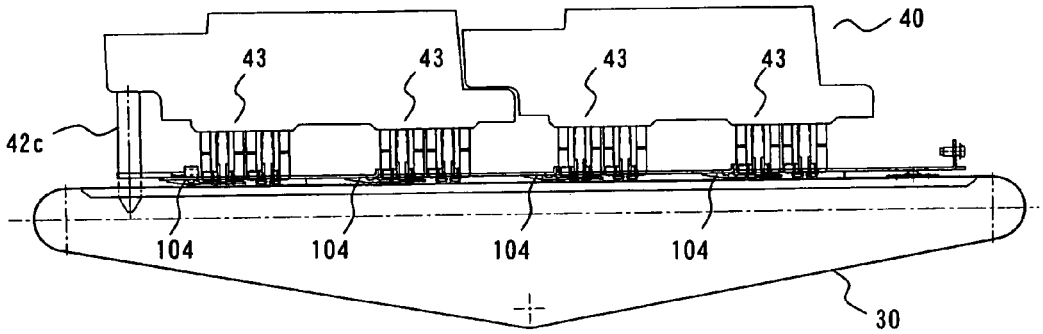
Figure 17:
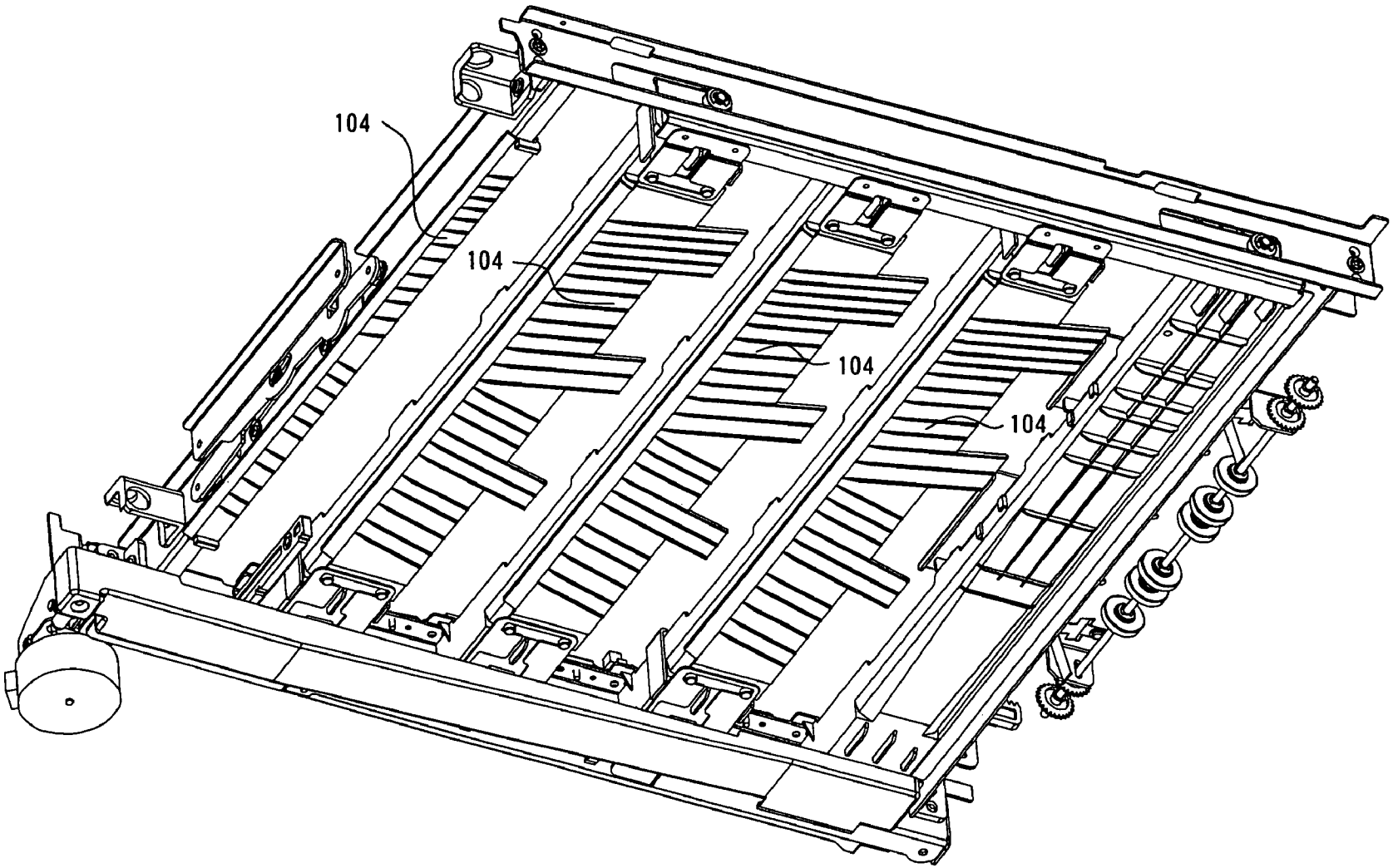
FIG. 17 is a diagonal view of a paper guide unit for describing the second embodiment.

The next description is of a second embodiment while referring to FIGS. 16 and 17. FIG. 16A is an illustrative top view of the paper guide unit and FIG. 16B a cross-sectional view of the paper guide unit.

FIGS. 16 and 17 show a configuration with the guide rollers 101 and 102 being removed from the configuration of the first embodiment and a recording paper with a curl or wrinkle is guided and transported by a paper guide rib 104 only. Incidentally, the configuration is such that the paper guide rib 104 is positioned on the outside in terms of the recording paper width direction in the downstream as compared to the upstream of the recording paper transport direction as described above. The configuration of the paper guide rib 104 is mutually reversed at the center position PWC of the recording paper width direction.

The present embodiment does not comprise guide rollers 101 or 102, thus no function of pressing a recording paper down onto the platen belt 31, but the configuration is such that the distance between the edge of the paper guide rib 104 (i.e., the utmost downstream in terms of the recording paper transport direction) and the platen belt 31 is set at no more than the head gap HG, hence the paper guide rib 104 forces a curl or wrinkle of a recording paper, which is not adequately sucked by the suction force of the platen unit 30, down onto the platen belt 31.

The recording paper forced down onto the platen belt 31 by the edge part of the paper guide rib 104 is printed on and fed through without coming in contact with the recording head 43.

Such a configuration which places the paper guide for forcing a recording paper in the platen direction for each of the recording heads placed across the entire area of recording upstream of the recording head, thereby making it possible to feed paper without a recording paper with a curl, wrinkle or cockling coming in contact with the recording head 43. This prevents an occurrence of paper jam or ink contamination on a recording paper.

Figure 18A:
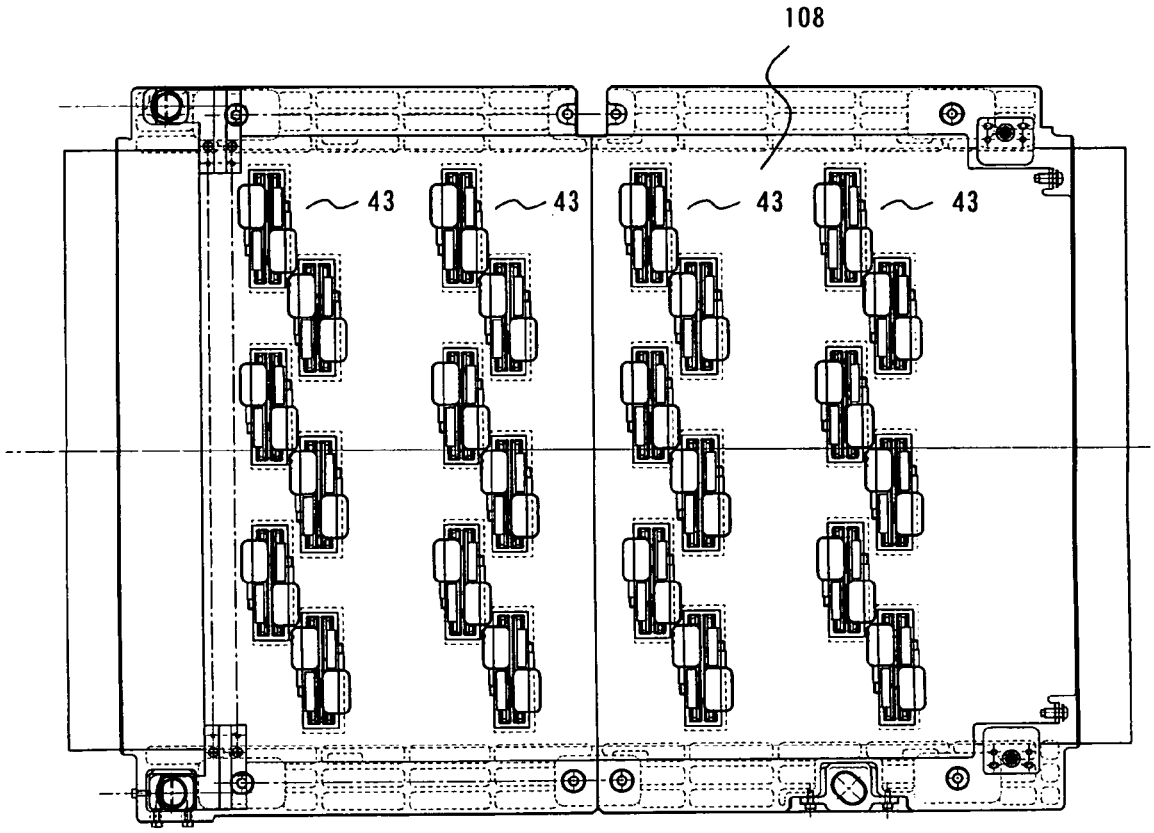
FIG. 18A is an illustrative top view of a paper guide unit for describing a third embodiment and FIG. 18B a cross-sectional view of the paper guide.
Figure 18B:
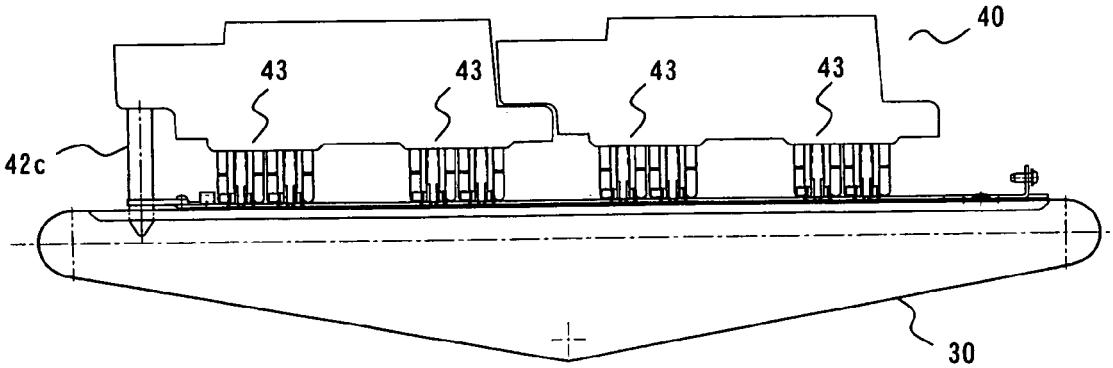

The next description is of a third embodiment while referring to FIG. 18. Note that FIG. 18A is an illustrative top view of a paper guide unit and FIG. 18B a cross-sectional view of the paper guide.

As shown by FIG. 18, the present embodiment is configured to mount a guide plate 108 onto the maintenance unit 60 directly. The guide plate 108 has openings for the respective parts of recording heads 43 and all the other part facing the platen belt 31 by keeping the distance smaller than the head gap HG.

The above described configuration also makes it possible to retain a lifting amount PH of a recording paper with a curl or wrinkle at no larger than the head gap HG.

Note that the above descriptions are specific to the preferred embodiments according to an example of the present invention which, however, includes all possible embodiments to be carried out within the scope of the present invention, in lieu of being limited by the above described embodiments.

As such, the present embodiment is configured to place paper suppression rollers upstream and downstream of the recording heads, for each of the recording heads arranged across the entire recording area, thereby making it possible to prevent a recording paper from an ink contamination and improve a print quality without allowing a recording paper having a curl, wrinkle or cockling to come in contact with the recording head.

And a lifting amount of a recording paper having a curl, wrinkle or cockling is suppressed by the paper guide, even the lifting amount of a recording paper having a large curl is suppressed to the head gap or less, thus the transport of a recording paper is carried out stably, a lifting of a recording paper is held down, a contamination of a recording paper or a nozzle clogging of a recording head is prevented and paper jams are reduced.

What is claimed is:

1. A recording apparatus, comprising:

a recording head row including a plurality of recording heads arranged to form an image by ejecting ink onto a recording paper, the recording head row extending in a longitudinal direction across a width of the recording paper, and each of the recording heads partly overlapping an adjacent recording head in the recording head row in the longitudinal direction;

a recording paper transport unit arranged opposite the recording heads for transporting the recording paper in a flat state;

a plurality of recording paper bias units, each arranged upstream of and in alignment with at least one of the plurality of recording heads and proximate the at least one recording head to bias the recording paper toward the recording paper transport unit and thereby prevent the recording paper from lifting off of the recording paper transport unit before the recording paper passes by the at least one of the recording heads.

2. The recording apparatus according to claim 1, further comprising a paper guide arranged upstream in a recording paper transport direction vis-à-vis said recording paper bias unit so as not to contact said recording paper transport unit for guiding a leading edge of the recording paper toward the recording paper bias unit.

3. The recording apparatus according to claim 2, wherein:

said recording paper bias unit comprises a roller which is driven vis-à-vis recording paper transportation.

4. The recording apparatus according to claim 1, wherein:

said recording paper bias unit comprises a paper guide which does not contact said recording paper transport unit.

5. The recording apparatus according to claim 3, wherein each of said rollers has a same width as an aligning one of the recording heads.

6. The recording apparatus according to claim 2, wherein:

said recording paper bias unit comprises a roller which is driven vis-a-vis recording paper transportation and wherein a distance between said paper guide and the recording paper is smaller than a radius of said roller.

7. The recording apparatus according to claim 6, wherein each of said rollers has a same width as an aligning one of the recording heads.

8. The recording apparatus according to claim 1, wherein:

said recording paper bias unit comprises a roller which is driven vis-à-vis recording paper transportation.

9. The recording apparatus according to claim 1, wherein:

said recording paper bias unit is treated by an ink-repellent processing at least for surfaces facing, or contacting with, the recording paper.

10. The recording apparatus according to claim 8, wherein each of said rollers has a same width as an aligning one of the recording heads.

11. The recording apparatus according to claim 1, wherein the recording heads are arranged to eject a same color ink onto the recording paper.

12. A recording apparatus comprising:

a recording head row including a plurality of recording heads arranged to form an image by ejecting ink onto a recording paper, the recording head row extending in a longitudinal direction across a width of the recording paper, and each of the recording heads partly overlapping an adjacent recording head in the recording head row in the longitudinal direction;

a recording paper transport unit arranged opposite the recording heads for transporting the recording paper in a flat state; and a plurality of biasing means each arranged upstream of and in alignment with at least one of the recording heads and proximate the at least one of the recording heads for biasing the recording paper toward the recording paper transport unit and thereby prevent the recording paper from lifting off of the recording paper transport unit before the recording paper passes by the at least one of the recording heads.

13. The recording apparatus according to claim 12, wherein said biasing means comprise rollers.

14. The recording apparatus according to claim 13, wherein each of said rollers has a same width as an aligning one of the recording heads.

15. The recording apparatus according to claim 13, wherein said biasing means comprises paper guide ribs.

16. The recording apparatus according to claim 13, wherein the recording heads are arranged to eject a same color ink onto the recording paper.

* * * * *